US009404410B2

(12) United States Patent
Nishikawa et al.

(10) Patent No.: US 9,404,410 B2
(45) Date of Patent: Aug. 2, 2016

(54) CONTROLLER FOR ENGINE COOLING SYSTEM

(71) Applicant: DENSO CORPORATION, Kariya, Aichi-pref (JP)

(72) Inventors: Michio Nishikawa, Obu (JP); Nobuharu Kakehashi, Toyoake (JP); Koji Ota, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 13/943,818

(22) Filed: Jul. 17, 2013

(65) Prior Publication Data

US 2013/0298851 A1 Nov. 14, 2013

Related U.S. Application Data

(62) Division of application No. 13/039,599, filed on Mar. 3, 2011, now abandoned.

(30) Foreign Application Priority Data

Mar. 3, 2010 (JP) ..... 2010-46588
Mar. 5, 2010 (JP) ..... 2010-49177

(51) Int. Cl.
*F01P 7/02* (2006.01)
*F01P 7/16* (2006.01)
(Continued)

(52) U.S. Cl.
CPC ... *F01P 7/02* (2013.01); *F01P 7/04* (2013.01); *F01P 7/164* (2013.01); *F01P 7/165* (2013.01); *F01P 5/00* (2013.01); *F01P 2003/027* (2013.01); *F01P 2003/185* (2013.01);
(Continued)

(58) Field of Classification Search
CPC ..... F01P 3/00; F01P 3/04; F01P 3/12; F01P 3/14; F01P 2003/001; F01P 2003/021; F01P 2003/024; F01P 2003/027; F01P 5/00; F01P 5/10; F01P 7/00; F01P 7/14; F01P 7/165; F01P 7/164
USPC ..... 123/41.21, 41.29, 41.72, 41.82 R
See application file for complete search history.

(56) References Cited

U.S. PATENT DOCUMENTS 4,370,950 A * 2/1983 Furukubo ..... 123/41.08
4,381,736 A * 5/1983 Hirayama ..... 123/41.1
(Continued)

FOREIGN PATENT DOCUMENTS

CN 101368504 2/2009
EP 1 008 471 6/2000
(Continued)

OTHER PUBLICATIONS

Machine translation of Detailed Description, EP1008471A1, Himmelsbach, publ'n. Jun. 14, 2000, obtained from worldwide.espacenet.com, pp. 1-9.*
(Continued)

*Primary Examiner* — Grant Moubry
(74) *Attorney, Agent, or Firm* — Nixon & Vanderhye P.C.

(57) ABSTRACT

An internal combustion engine has a cylinder-head-passage through which an engine coolant flows toward a water jacket when a water pump is operated. The water pump is an electric water pump utilizing the electric power charged in the battery. A radiator is provided in the cylinder-head-passage. Even after the engine is shut off, the water pump is kept driven.

7 Claims, 15 Drawing Sheets

(51) Int. Cl.

| | |
|---|---|
| ***F01P 7/04*** | (2006.01) |
| *F01P 5/00* | (2006.01) |
| *F01P 3/02* | (2006.01) |
| *F01P 3/18* | (2006.01) |
| *F01P 5/10* | (2006.01) |

(52) U.S. Cl.

CPC ..... *F01P 2005/105* (2013.01); *F01P 2025/30* (2013.01); *F01P 2025/66* (2013.01); *F01P 2031/30* (2013.01); *F01P 2037/02* (2013.01); *F01P 2060/08* (2013.01)

(56) References Cited

U.S. PATENT DOCUMENTS

| | | | | |
|---|---|---|---|---|
| 4,508,264 | A * | 4/1985 | Takeda et al. | 237/12.3 B |
| 4,539,942 | A * | 9/1985 | Kobayashi et al. | 123/41.1 |
| 4,726,325 | A * | 2/1988 | Itakura | F01P 7/048 123/41.1 |
| 5,215,044 | A * | 6/1993 | Banzhaf | F01P 1/00 123/41.05 |
| 5,337,704 | A | 8/1994 | Roth | |
| 5,701,851 | A * | 12/1997 | Nakano | F01P 7/165 123/41.1 |
| 5,901,786 | A * | 5/1999 | Patel et al. | 165/283 |
| 6,182,618 | B1 * | 2/2001 | Gutierrez, Jr. | 123/41.29 |
| 6,192,838 | B1 * | 2/2001 | Matsuo et al. | 123/41.01 |
| 6,340,006 | B1 * | 1/2002 | Malatto et al. | 123/41.29 |
| 6,644,248 | B2 * | 11/2003 | Luckner et al. | 123/41.1 |
| 6,679,201 | B2 | 1/2004 | Murakami et al. | |
| 6,688,262 | B2 | 2/2004 | Murakami et al. | |
| 6,688,263 | B1 | 2/2004 | Yamamoto et al. | |
| 6,817,321 | B2 | 11/2004 | Takei et al. | |
| 7,207,298 | B2 * | 4/2007 | Lee | 123/41.29 |
| 7,267,084 | B2 * | 9/2007 | Lutze et al. | 123/41.02 |
| 7,325,595 | B2 | 2/2008 | Homan et al. | |
| 7,363,804 | B2 | 4/2008 | Wakahara et al. | |
| 7,377,237 | B2 | 5/2008 | Carney et al. | |
| 7,717,069 | B2 * | 5/2010 | Mokire et al. | 123/41.31 |
| 7,743,651 | B2 | 6/2010 | Wakahara et al. | |
| 8,052,066 | B2 | 11/2011 | Watanabe et al. | |
| 8,893,669 | B2 * | 11/2014 | Mehring et al. | 123/41.29 |
| 2003/0019442 | A1 | 1/2003 | Yoshikawa et al. | |
| 2004/0103862 | A1 | 6/2004 | Aidnik | |
| 2009/0229543 | A1 | 9/2009 | Suzuki | |
| 2010/0236502 | A1 | 9/2010 | Watanabe et al. | |
| 2011/0214627 | A1 | 9/2011 | Nishikawa et al. | |

FOREIGN PATENT DOCUMENTS

| | | | |
|---|---|---|---|
| EP | 1008471 | A1 * | 6/2000 |
| EP | 2 045 452 | | 4/2009 |
| JP | 8-144758 | | 6/1996 |
| JP | 2003-239747 | | 8/2003 |
| JP | 2004-108159 | | 4/2004 |
| JP | 2005-090236 | | 4/2005 |

OTHER PUBLICATIONS

Office Action (2 pages) dated Jun. 11, 2013 issued in corresponding Japanese Application No. 2010-046588 and English translation (2 pages).

Office Action (11 pages) dated Jun. 4, 2013, issued in parent U.S. Appl. No. 13/039,599 of Nishikawa, filed Mar. 3, 2011.

Office Action (6 pages) dated Jun. 3, 2013 issued in corresponding Chinese Application No. 201110052260.X and English translation (7 pages).

Chinese Office Action dated Jul. 23, 2014, in CN App. No. 201310080886.0 (with partial English translation).

Office Action issued in Chinese Application No. 201310080886.0 dated Mar. 19, 2015 (w/ translation).

* cited by examiner

CONTROLLER FOR ENGINE COOLING SYSTEM

This application is a Divisional of application Ser. No. 13/039,599, filed Mar. 3, 2011 and claims priority from Japanese Patent Applications No. 2010-46588 filed on Mar. 3, 2010, and No. 2010-49177 filed on Mar. 5, 2010, the disclosures of each of which are incorporated herein by reference.

FIELD OF THE INVENTION

The present invention relates to a controller for an engine cooling system. Further, the present invention relates to an air-conditioner for an automobile in which heating is performed by use of engine coolant.

BACKGROUND OF THE INVENTION

JP-8-144758A shows an engine cooling system in which engine coolant is circulated in order to cool a cylinder head and cylinder block of an engine. A mechanical water pump circulating the engine coolant is driven by a driving force transmitted from a crankshaft of the engine. While the engine is running, the mechanical water pump is also driven in order to circulate the engine coolant. A combustion chamber of the engine is also cooled, so that anti-knocking ability is improved.

If the engine is shut down with high temperature, the cylinder head temperature may be greater than a specified temperature when the engine is restarted. This specified temperature is established for improving the anti-knocking ability. If the engine is restarted with the cylinder head of high temperature, fuel consumption efficiency may be deteriorated.

Especially, in a vehicle having an idle reduction function and a vehicle having a hybrid engine, the equipped engine is frequently stopped and restarted. Thus, the above problems often occur.

U.S. Pat. No. 5,337,704 shows an engine cooling system in which engine coolant passed through a cylinder-head passage flows into a heat exchanger for heating a passenger compartment.

EP-1008474A1 shows a heating system which includes two heat exchangers into which engine coolant is respectively introduced.

In order to improve the anti-knocking ability, a cylinder head should be positively cooled.

Meanwhile, in order to restrict an increase in friction in an engine, a cylinder block should be kept at specified temperature or more. A cylinder-head-passage and a cylinder-block-passage are formed in the system, and coolant flow rate flowing through the cylinder-head passage is made larger than that flowing through the cylinder-block-passage.

When the engine coolant passed through only the cylinder head is used as a heat source for heating a passenger compartment, it is likely that the air temperature can not be increased enough.

SUMMARY OF THE INVENTION

The present invention is made in view of the above matters, and it is an object of the present invention to provide a controller for an engine cooling system, which is capable of improving an anti-knocking ability even when the engine is restarted. Further, it is another object of the present invention to provide an air-conditioner for an automobile which can sufficiently heat a passenger compartment by use of an engine coolant passed through a cylinder head.

In an engine cooling system, an electric pump is controlled in such a manner as to circulate a coolant so that a cylinder head of an internal combustion engine is cooled. A controller for an engine cooling system includes: a temperature obtaining means for obtaining a temperature of the coolant; a temperature determination means for determining a target temperature of the coolant at which an anti-knocking ability of the internal combustion engine is improved; and a cooling control means for driving the electric pump to cool the cylinder head even after the internal combustion engine is shut off in a case that the temperature of coolant obtained by the temperature obtaining means exceeds the target temperature determined by the temperature determination means.

According to the above configuration, even after the engine is shut off, the cylinder head can be cooled in order to improve an anti-knocking ability. Thus, even if the engine is restarted at arbitrary timing, a cylinder head temperature has been preferably controlled. Even at restarting of the engine, the anti-knocking ability can be improved.

According to another aspect of the present invention, the temperature determination means continues to execute a target temperature determination processing even after the internal combustion engine is shut off. Thus, also after the engine is shut off, the cooling control processing can be executed.

According to another aspect of the invention, the engine cooling system is applied to an engine cooling system of a hybrid vehicle equipped with both an internal combustion engine and an electric motor. The cooling control means continues to drive the electric pump even when the temperature of the coolant becomes less than the target temperature of the coolant in a case that the internal combustion engine is shut off and a vehicle speed is greater than or equal to a specified value. Even when the engine is shut off, if the vehicle speed greater than a specified value, it is likely that the engine is restarted. That is, when the driver slightly steps on the accelerator pedal, the engine is restarted. Since the electric pump continues to be driven, a rapid increase in temperature of the cylinder head can be restricted.

According to another aspect of the invention, the cooling control means includes a first cooling control means for increasing a coolant flow rate in such a manner that the coolant flow rate becomes greater than an reference flow rate in a case that the temperature of the coolant obtained by the temperature obtaining means is greater than the target temperature of the coolant; and a second cooling control means for decreasing the coolant flow rate in such a manner that the coolant flow rate becomes less that the reference flow rate in a case that a difference between the temperature of the coolant obtained by the temperature obtaining means and the target temperature of the coolant is within a specified range. When the difference between the coolant temperature and the target coolant temperature is within a range, the electricity supplied to the electric pump is reduced. Thus, the electric power of the battery can be saved.

According to another aspect of the invention, the engine cooling system includes a radiator which cools the coolant by heat-exchanging with ambient air, and the temperature determination means obtains an ambient air temperature and determines the target temperature in such a manner as to be greater than the ambient air temperature. Thereby, even though the coolant temperature supplied to the cylinder head is around the ambient temperature, it can be avoided that the electric pump continues to be driven.

According to another aspect of the invention, an radiator is arranged downstream of a refrigerant condenser of an air conditioner, and the temperature determination means determines the target temperature of the coolant so that the target temperature is greater than a specified temperature which is obtained by adding an addition temperature to the ambient air temperature. The addition temperature corresponds to a heat radiation quantity of the refrigerant condenser. According to the above configuration, the electric power saving is further accelerated.

According to another aspect of the invention, the engine cooling system includes a radiator and an electric cooling fan. The radiator cools the coolant by heat-exchanging with ambient air. The electric cooling fan introduces the ambient air toward the radiator. The controller further includes a cooling fan control means for driving the electric cooling fan even after the internal combustion engine is shut off in a case that the temperature of the coolant exceeds the target temperature of the coolant. In a case that the internal combustion engine is started while the electric pump is stopped, the cooling control means starts driving the electric pump even though the temperature of the coolant does not exceeds the target temperature of the coolant. In a case that the temperature of the coolant does not exceeds the target temperature of the coolant, the cooling fan control means does not starts the electric cooling fan even though the internal combustion engine is started while the electric cooling fan is stopped. In a case that the temperature of the coolant becomes greater than the target temperature, the electric cooling fan is started.

Thus, a rapid increase in temperature of the cylinder head can be easily restricted. Even if the engine is restarted, the electric cooling fan is not started. The electric cooling fan is started when the coolant temperature exceeds the target coolant temperature. The electric power for driving the cooling fan can be saved. It should be noted that the temperature obtaining means obtains a temperature of the coolant in the radiator, a water jacket of the cylinder head, an outlet of the water jacket, or an inlet of the water jacket. Most preferably, the temperature obtaining means obtains the temperature of the coolant in the cylinder head or at outlet of a water jacket of the cylinder head. Thus, the temperature of the coolant can be correctly detected.

An air-conditioning system comprises a heat-exchanger for heating an air with a coolant of an internal combustion engine. The internal combustion engine has a first coolant outlet through which the coolant passed through a cylinder head flows out, and a second coolant outlet through which the coolant passed through a cylinder block flows out. The heat-exchanger is comprised of a first exchanging portion and a second exchanging portion. The first exchanging portion receives the coolant from at least the first coolant outlet, and the second exchanging portion receives the coolant from the second coolant outlet of which temperature is higher than that of the coolant flowing into the first exchanging portion.

According to the above configuration, the air temperature passed through the second exchanging portion can be increased more than the case where the air is heated by the low temperature coolant discharged from the first coolant temperature or the case where the air is heated by mixture of high-temperature coolant and the low-temperature coolant. Thus, the air which will be introduced into a passenger compartment can be sufficiently heated.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

First Embodiment

Figure 1:
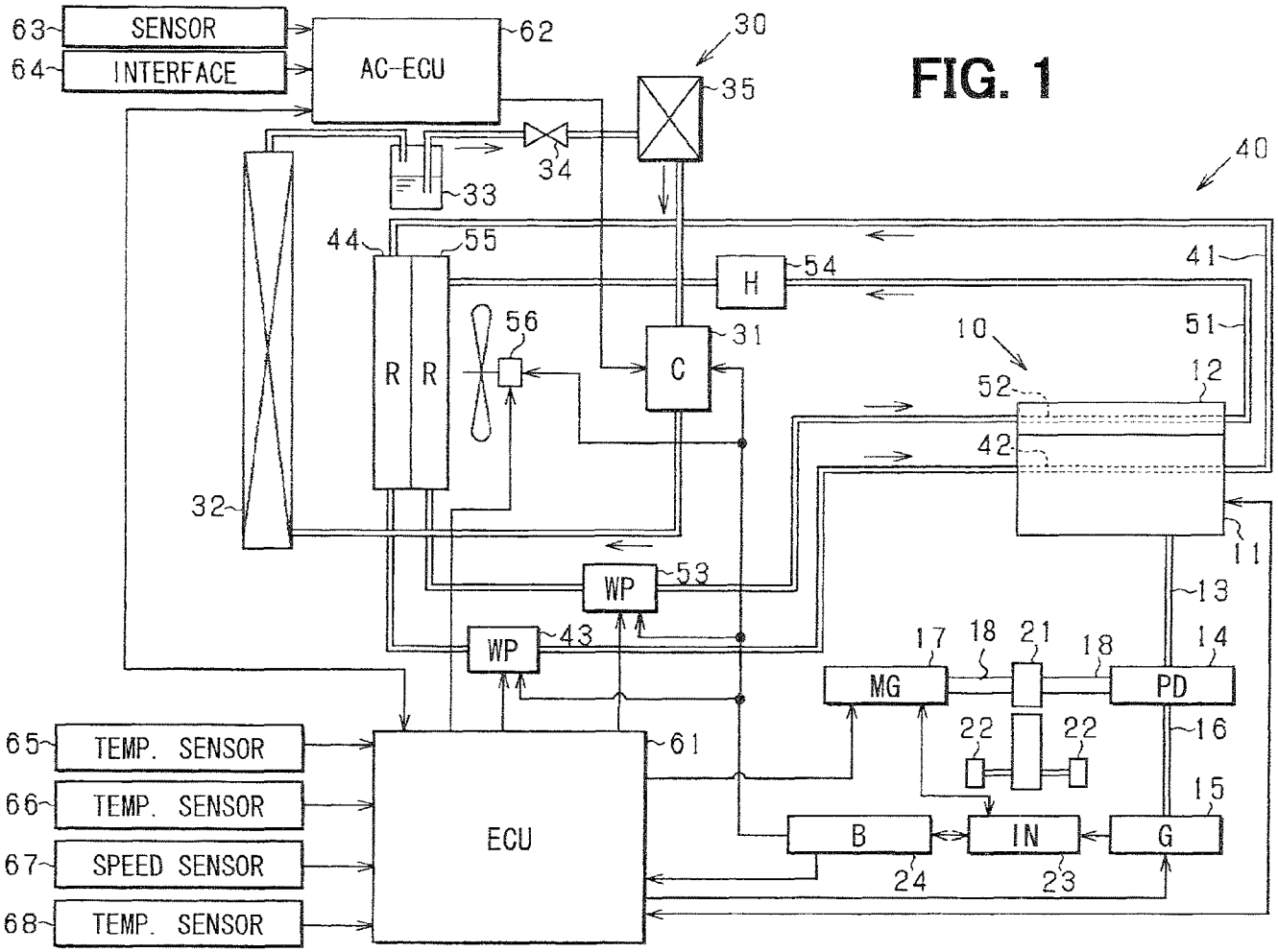
FIG. 1 is a schematic chart showing an engine control system.

Hereinafter, a first embodiment that embodies the present invention will be described with reference to the drawings. In the present embodiment, a vehicle is equipped with a hybrid engine. FIG. 1 schematically shows an entire configuration of a control system in a first embodiment.

A vehicle is equipped with an internal combustion engine 10. The engine 10 is comprised of a cylinder block 11 and a cylinder head 12. The cylinder block 11 has a cylinder (not shown) in which a piston is slidably provided. The cylinder head 12 is provided on the cylinder block 11 to define a combustion chamber.

When air-fuel mixture is combusted in the combustion chamber, the piston slides downward. An output shaft 13 of the engine 10 is connected to a power distribution portion 14. The power distribution portion 14 has a planetary gear mechanism including a planetary gear, a sun gear and a ring gear. The planetary gear is connected to the output shaft 13 of the engine 10, the sun gear is connected to a first shaft 16 for driving a generator 15, and the ring gear is connected to a second shaft 18 for driving a motor generator 17.

The torque of the engine 10 is distributed to the first shaft 16 and the second shaft 18 through the power distribution portion 14. The second shaft 18 is connected to wheels 22 through a reduction gear mechanism 21. The generator 15 generates electricity which is charged in a battery 24 through an inverter 24. The motor generator 17 is driven receiving electric power from the battery 24. The torque generated by the motor generator 17 is transmitted to the wheels 22 through the second shaft 18.

When the vehicle is accelerated or the vehicle is running in a high-load condition, both the internal combustion engine 10 and the motor generator 17 generate the torque. When the vehicle is running in low speed, the internal combustion engine 10 is stopped and the motor generator 17 generates torque. Meanwhile, when the vehicle is decelerated, the internal combustion engine 10 is stopped and the motor generator 17 generates electricity by regenerating a running energy, so that the battery 24 is charged. It should be noted that the battery 24 can be charged by driving the engine 10 when the vehicle is stopped.

The vehicle is equipped with an air conditioning system 30 for cooling a passenger compartment. The air conditioning system 30 is comprised of a compressor 31, a condenser 32, a receiver 33, an expansion valve 34, and an evaporator 35. The compressor 31 is an electric compressor utilizing the electric power charged in the battery 24.

Further, the vehicle is equipped with an engine cooling system 40 for cooling the engine 10. The engine cooling system 40 has a cylinder-block-passage 41 through which the engine coolant flows in order to cool the cylinder block 11 and a cylinder-head-passage 51 through which the engine coolant flows in order to cool the cylinder head 12. These passages 41, 51 are fluidly isolated from each other.

The cylinder-block-passage 41 is fluidly connected to a water jacket 42 of the cylinder block 11. A first water pump 43 is provided in the cylinder-block-passage 41 to supply the engine coolant toward the water jacket 42 of the cylinder block 11. The first water pump 43 is an electric water pump utilizing the electric power charged in the battery 24. Further, a first radiator 44 is arranged in the cylinder-block-passage 41. The first radiator 44 is for cooling the engine coolant passed through the water jacket 42.

The cylinder-head-passage 51 is fluidly connected to a water jacket 52 of the cylinder head 12. A second water pump 53 is provided in the cylinder-head-passage 51 to supply the engine coolant toward the water jacket 52 of the cylinder head 12. The second water pump 53 is also an electric water pump utilizing the electric power charged in the battery 24. Further, a heater core 54 and a second radiator 55 are provided in the cylinder-head-passage 51.

The engine coolant flows through the heater core 54 before flowing through the second radiator 55. The heater core 54 is for heating air which will be supplied to the passenger compartment. The temperature in the passenger compartment is controlled by adjusting air flow rate flowing through the heater core 54 and bypassing the heater core 54.

The second radiator 55 is for cooling the engine coolant passed through the water jacket 52. The first radiator 44 and the second radiator 55 are assembled together and are arranged downstream of the condenser 32 in an introduced outside-air-flow direction.

The first radiator 44 is arranged upstream of the second radiator 55 in the introduced outside-air-flow direction.

A cooling fan 56 is arranged downstream of the first and second radiators 44, 55 to introduce the outside air toward the radiators 44, 55. The cooling fan 56 is an electric fan utilizing electric power charged in the battery 24.

The present control system is provided with an electronic control unit (ECU) 61 and an electronic control unit for air conditioner (AC-ECU) 62. The ECU 61 and the AC-ECU 62 are mainly constructed of a microcomputer having a CPU, a ROM, a RAM and a backup memory.

The AC-ECU 62 receives signals from a room temperature sensor 63 and a user interface 64. Based on these signals, the AC-ECU 62 controls the compressor 31 based on the received signals.

The ECU 61 executes fuel injection control and ignition timing control. Further, the ECU 61 controls the generator 15 and the motor generator 17. The ECU 61 receives signals from a first coolant-temperature sensor 65, a second coolant-temperature sensor 66, a vehicle speed sensor 67, and an ambient temperature sensor 68. The first coolant-temperature sensor 65 detects coolant temperature at an outlet or an inlet of the water jacket 52 of the cylinder head 12. Alternatively, the first coolant-temperature sensor 65 may detect coolant temperature in the water jacket 52 of the cylinder head 12. The second coolant-temperature sensor 66 detects coolant temperature at an outlet or an inlet of the water jacket 42 of the cylinder block 11 or coolant temperature in the water jacket 42 of the cylinder block 11. Thus, the temperature of the cylinder head 12 and the cylinder block 11 can be correctly detected. The coolant temperature detected by the first sensor 65 is referred to as head-coolant temperature "Thead", and the coolant temperature detected by the second sensor 66 is referred to as block-coolant temperature "Tblock", hereinafter. Also, each of temperature sensor 65, 66 may detects coolant temperature in the corresponding radiator 44, 55. Based on the received signals, the ECU 61 controls the first water pump 43, the second water pump 53 and the cooling fan 56 so as to cool the cylinder block 11 and the cylinder head 12. Further, the ECU 61 receives various information signals from the AC-ECU 62.

The ambient temperature sensor 68 is provided to detect ambient air temperature around the condenser 32 and the radiators 44, 55. The ECU 61 can be comprised of two units. One of units controls the engine 10 and the other controls the generator 15 and the motor generator 17.

Figure 2A:
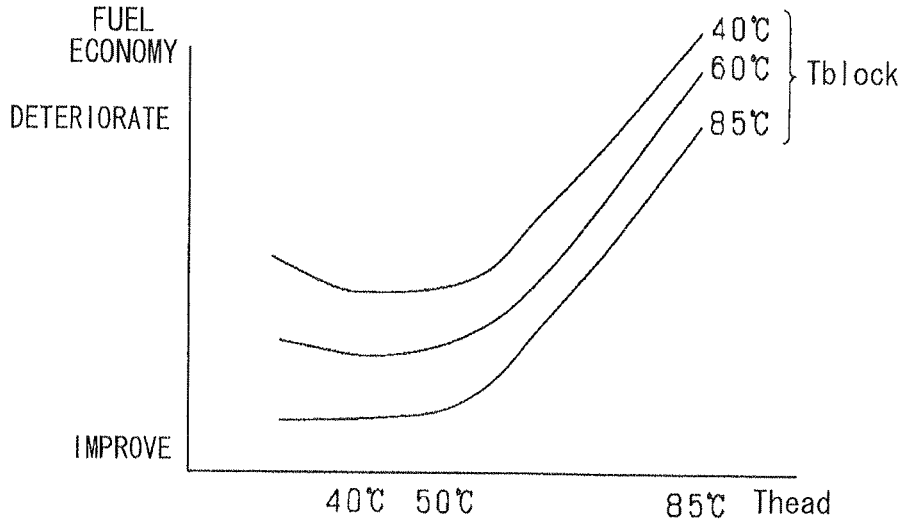
FIG. 2A is a graph showing a relationship between a head-coolant temperature "Thead", a block-coolant temperature "Tblock" and a fuel economy.
Figure 2B:
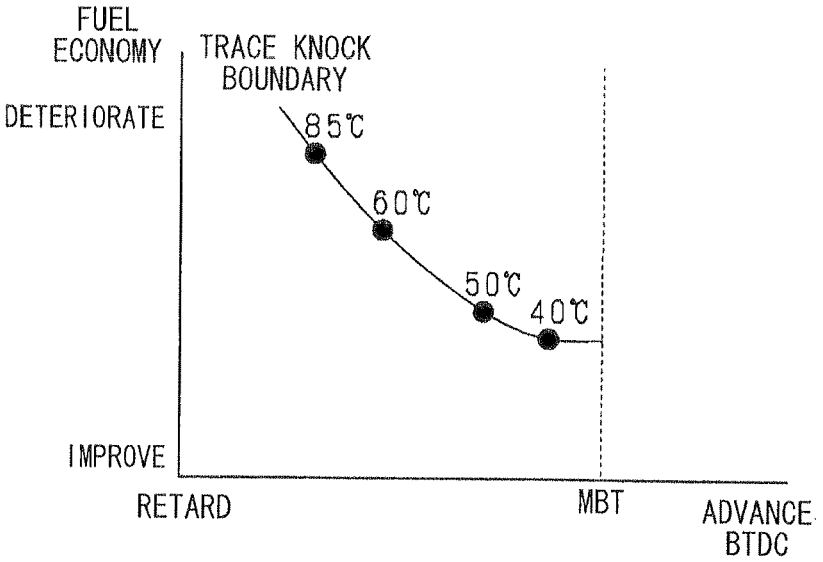
FIG. 2B is a graph showing a relationship between an ignition timing, a head-coolant temperature "Thead" and a fuel economy.

As shown in FIG. 2A, when the block-coolant temperature "Tblock" is low, friction is increased. Thus, it is preferable that the block-coolant temperature "Tblock" is maintained at high temperature. Specifically, the block-coolant temperature "Tblock" should be maintained at 85° C. Meanwhile, as the head-coolant temperature "Thead" is lower, the anti-knocking ability is improved. Thus, it is preferable that the head-coolant temperature "Thead" is maintained at low temperature. As shown in FIG. 2B, as the head-coolant temperature "Thead" becomes lower, the ignition timing in trace knock is more advanced, so that the ignition timing comes close to the MBT.

Figure 3:
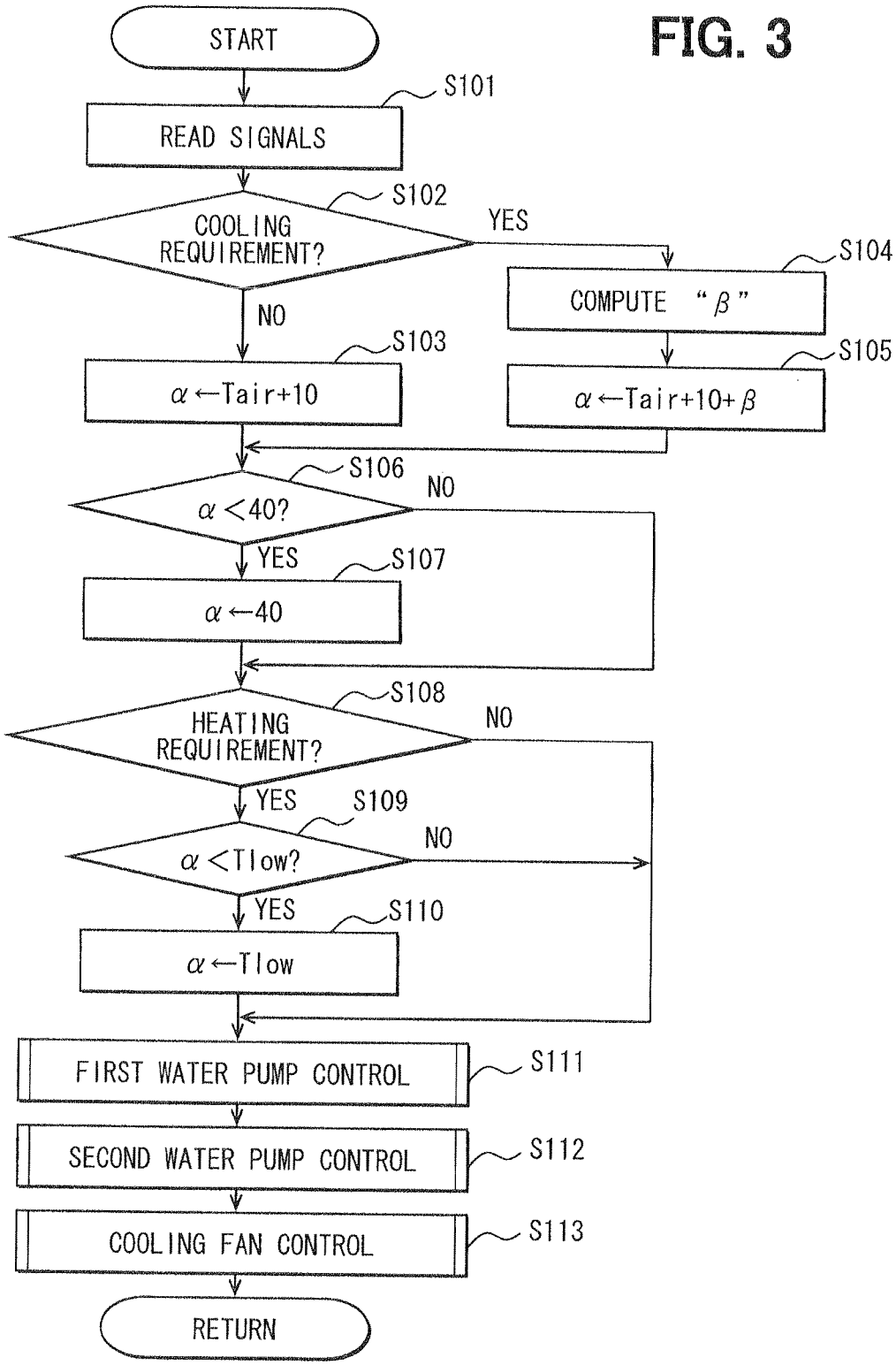
FIG. 3 is a flowchart showing a cooling control processing.

Referring to FIG. 3, a cooling control processing will be described, in which the block-coolant temperature "Tblock" and the head-coolant temperature "Thead" are suitably controlled.

This cooling control processing is executed in a specified cycle by the ECU 61. It should be noted that this cooling control processing can be executed for a specified time period even after the ignition switch is turned off.

In step S101, the computer of the ECU 61 reads various signals from sensors, such as the first coolant-temperature sensor 65, the second coolant-temperature sensor 66, the vehicle speed sensor 67, and the ambient temperature sensor 68. Further, the computer receives information about a cooling requirement. If the cooling requirement exists, the computer receives information about heat radiation quantity of the condenser 32. The heat radiation quantity of the condenser 32 can be derived by use of a predetermined map. Based on a detection signal of a room temperature sensor 63 and a cooling requirement level, the heat radiation quantity of the condenser 32 is computed according to cooling load (load of air conditioner). Alternatively, the heat radiation quantity can be computed based on a driving condition of the compressor 31, the refrigerant pressure and the cooling requirement level.

Also in step 101, the computer receives information about a heating requirement. If the heating requirement exists, the computer receives information about a lower limit temperature of the coolant. The information about the lower limit temperature of the coolant can be derived by use of a predetermined map based on the detection signal of the room temperature sensor 63. The process in step S101 corresponds to an obtaining means of the present invention.

Then, in steps S102-S110, a coolant temperature threshold $\alpha$ is computed. The processes for computing the threshold $\alpha$ corresponds to a temperature determining means of the present invention. The coolant temperature threshold $\alpha$ is a parameter for switching a driving level of the second water pump 53 and/or the cooling fan 56. In the case that the head-coolant temperature "Thead" is higher than the threshold $\alpha$, the second water pump 53 and/or the cooling fan 56 is driven in high driving level.

Specifically, in step S102, the computer determines whether the cooling requirement is established. When the answer is NO, the procedure proceeds to step S103 in which "ambient air temperature Tair detected by the sensor 68+10° C." is defined as the threshold $\alpha$. Specifically, the threshold $\alpha$ is between 40° C. and 60° C. Thereby, it is restricted that the driving levels of the second water pump 53 and the cooling fan 56 cooling are maintained at high driving level even though the head-coolant temperature "Thead" is lower than the ambient air temperature "Tair".

Meanwhile, when the answer is YES, the procedure proceeds to step S104 in which addition temperature $\beta$ for cooling is computed. This addition temperature $\beta$ is computed based on the heat radiation quantity of the condenser 32 computed in step S101 and air velocity flowing toward the condenser 32 and the radiators 44, 55. The air velocity is computed based on the vehicle speed "VS" detected by the vehicle speed sensor 67 and the driving level of the cooling fan 56. Then, the procedure proceeds to step S105 in which the threshold $\alpha$ is defined as "ambient air temperature Tair+10° C.+$\beta$(° C.)". Since the heat radiation of the condenser 32 has some effect on the cooling efficiency of the second radiator 55, the threshold $\alpha$ is determined based on the addition temperature $\beta$. In steps S103 and S105, the added temperature value "10° C." is variable.

Then, the procedure proceeds to step S106 in which the computer determines whether the threshold $\alpha$ is less than 40° C. When the answer is YES in step S106, the procedure proceeds to step S107 in which the threshold $\alpha$ is reset to 40° C. As described above, as the head-coolant temperature "Thead" is decreased, the anti-knocking ability is improved. However, such effect is converged around 40° C., as shown in FIG. 2B.

Meanwhile, the threshold $\alpha$ is a reference to determine whether driving level of the second water pump 53 and the cooling fan 56 should be set higher. As the driving level is set higher, the electric power consumption of the battery 24 is increased. Therefore, the coolant temperature threshold $\alpha$ has a lower limit value.

Then, the procedure proceeds to step S108 in which the computer determines whether the heating requirement is established. When the answer is YES in step S108, the procedure proceeds to step S109 in which the computer determines whether the current coolant temperature threshold $\alpha$ is less than the lower limit value "Tlow" associated with the heating requirement. When the answer is YES in step S109, the procedure proceeds to step S110 in which the coolant temperature threshold $\alpha$ is reset to the lower limit value "Tlow" associated with the heating requirement. When the answer is NO, the procedure proceeds to step S111. As described above, the coolant temperature threshold $\alpha$ is established to satisfy the heating requirement.

Then, the procedure proceeds to step S111 in which a first water pump control is executed. In step S112, a second water pump control is executed. In step S113, a cooling fan control is executed.

Figure 4:
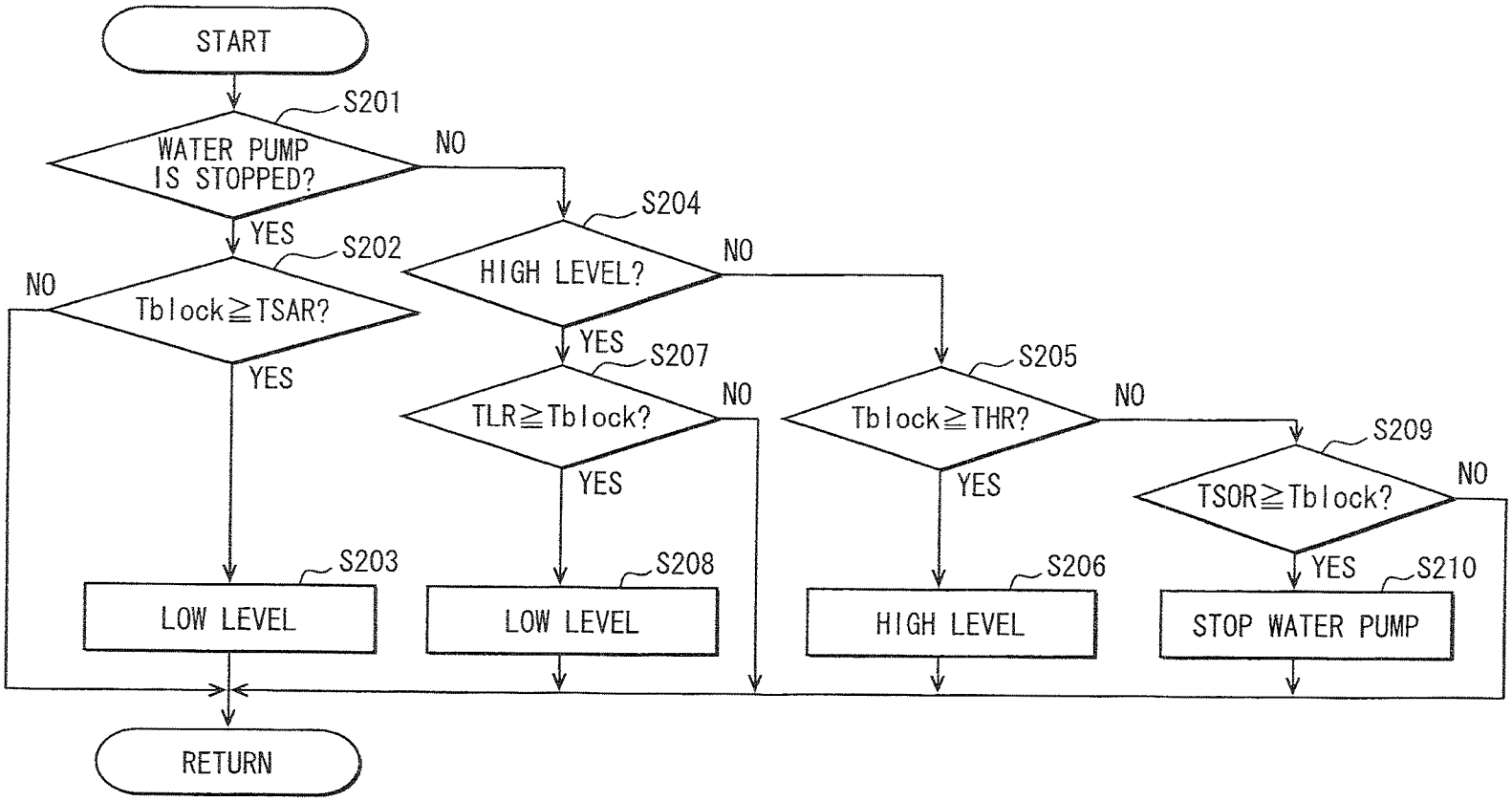
FIG. 4 is a flowchart showing a control processing of a first water pump.

FIG. 4 is a flow chart showing the first water pump control executed in step S111.

In step S210, the computer determines whether the first water pump 43 is stopped. When the answer is YES, the procedure proceeds to step S202 in which the computer determines whether the block-coolant temperature "Tblock" is greater than or equal to a start reference temperature "TSAR" (for example, 85° C.). When the answer is NO in step S202, the procedure ends. When the answer is YES in step S202, the procedure proceeds to step 203 in which the first water pump 43 is driven in low driving level.

When the answer is NO in step S201, the procedure proceeds to step S204 in which the computer determines whether the first water pump 43 is driven in high driving level. It should be noted that the discharge quantity of the first water pump 43 per unit time in high driving level is greater than that in low driving level. The first water pump 43 consumes more electricity in high driving level than in low driving level. When the answer is NO in step S204, the procedure proceeds to step S205 in which the computer determines whether the block-coolant temperature "Tblock" is greater than or equal to a high-level reference temperature "THR" (for example, 100° C.). When the answer is YES in step S205, the procedure proceeds to step S206 in which the first water pump 43 is driven in high driving level.

When the answer is YES in step S204, the procedure proceeds to step S207 in which the computer determines whether the block-coolant temperature "Tblock" is less than or equal to a low-level reference temperature "TLR" (for example, 95° C.). When the answer is YES in step S207, the procedure proceeds to step S208 in which the first water pump 43 is driven in low driving level.

In step S209, the computer determines whether the block-coolant temperature "Tblock" is less than or equal to stop reference temperature "TSOR" (for example, 80° C.). When the answer is YES in step S209, the procedure proceeds to step S210 in which the first water pump 43 is stopped.

That is, the first water pump 43 is not started until the block-coolant temperature "Tblock" becomes the start reference temperature "TSAR". After the first water pump 43 is started, the first water pump 43 keeps running until the block-coolant temperature "Tblock" becomes less than or equal to the stop reference temperature "TSOR". Thereby, the block-coolant temperature "Tblock" is kept around the start reference temperature "TSAR" irrespective of whether the engine 10 is running. The start reference temperature "TSAR" is established in such a manner that friction is restricted and heavy thermal load is not applied to the cylinder block 11.

Figure 5:
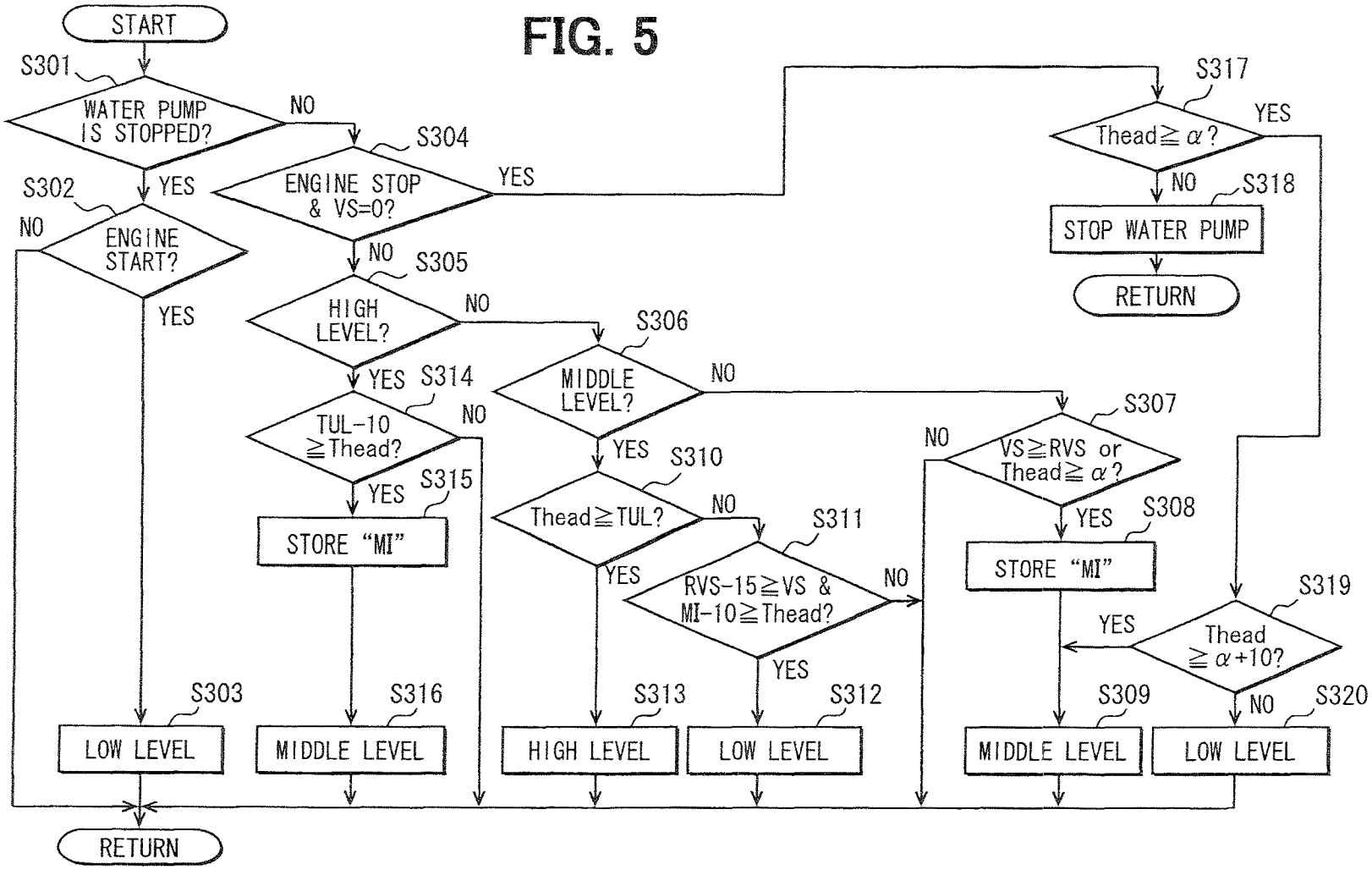
FIG. 5 is a flowchart showing a control processing of a second water pump.

FIG. 5 is a flow chart showing the second water pump control executed in step S112. This control processing corresponds to cooling control means of the present invention.

In step S301, the computer determines whether the second water pump 53 is stopped. When the answer is YES, the procedure proceeds to step S302 in which the computer determines whether the engine 10 has been started. When the answer is NO in step S302, the procedure ends. When the answer is YES in step S302, the procedure proceeds to step 303 in which the second water pump 53 is driven in low driving level.

When the answer is NO in step S301, the procedure proceeds to step S304 in which the computer determines whether the engine 10 is stopped and the vehicle speed "VS" is "0". When the answer is NO in step S304, the procedure proceeds to step S305 in which the computer determines whether the second water pump 53 is driven in high driving level. When the answer is NO in step S305, the procedure proceeds to step S306 in which the computer determines whether the second water pump 53 is driven in middle driving level. A discharge quantity of the second water pump 53 in the middle driving level is greater than that in low driving level and less than that in high driving level.

When the answer is NO in step S306, that is, when the second water pump 53 is driven in the low driving level, the procedure proceeds to step S307 in which the computer determines whether the vehicle speed "VS" is greater than or equal to a reference vehicle speed "RVS" (for example, 30 km/h) or whether the head-coolant temperature "Thead" is greater than or equal to the coolant temperature threshold α. When the answer is NO in step S307, the procedure ends. When the answer is YES in step S307, the procedure proceeds to step S308 and step S309. In step S308, the current coolant temperature threshold α is stored as momentum information "MI". In step S309, the driving level of the second water pump 53 is set to the middle driving level.

Even though the head-coolant temperature "Thead" is not greater than or equal to the threshold α, when the vehicle speed "VS" is greater than the reference vehicle speed "RVS", the driving level of the second water pump 53 is changed from the low driving level to the middle driving level. Thus, it is possible to enhance the cooling efficiency based on an estimation of engine start. It can be avoided that the head-coolant temperature "Thead" suddenly exceeds the threshold α.

When the answer is YES in step S306, the procedure proceeds to step S310 in which the computer determines whether the head-coolant temperature "Thead" is greater than or equal to an upper limit temperature "TUL" (for example, 70° C.). The upper limit temperature "TUL" is greater than the coolant temperature threshold α. When the answer is NO in step S310, the procedure proceeds to step S311 in which the computer determines whether the current vehicle speed "VS" is less than or equal to "RVS−15" and the head-coolant temperature "Thead" is less than or equal to "MI−10". When the answer is YES in step S311, the procedure proceeds to step S312 in which the driving level of the second water pump 53 is set to the low driving level. When the answer is YES in step S310, the procedure proceeds to step S313 in which the driving level of the second water pump 53 is set to the high driving level.

When the answer is YES in step S305, the procedure proceeds to step S314 in which the computer determines whether the head-coolant temperature "Thead" is less than or equal to "TUL−10". When the answer is YES in step S314, the procedure proceeds to step S315 in which the momentum information "MI" is stored. In step S316, the driving level of the second water pump 53 is changed to the middle driving level.

When the answer is NO in step S301 and the answer is YES in step S304, the procedure proceeds to step S317. In step S317, the computer determines whether the head-coolant temperature "Thead" is greater than or equal to the coolant temperature threshold α. When the answer is NO, the procedure proceeds to step S318 in which the second water pump 53 is stopped. When the answer is YES in step S317, the procedure proceeds to step S319 in which the computer determines whether the head-coolant temperature "Thead" is greater than or equal to a value obtained by adding a specified value (for example, 10° C.) to the threshold α.

When the answer is YES in step S319, the procedure proceeds to step S309 in which the driving level of the second water pump 53 is set to the middle driving level. When the answer is NO in step S319, the procedure proceeds to step S320 in which the driving level of the second water pump 53 is set to the low driving level.

Figure 6:
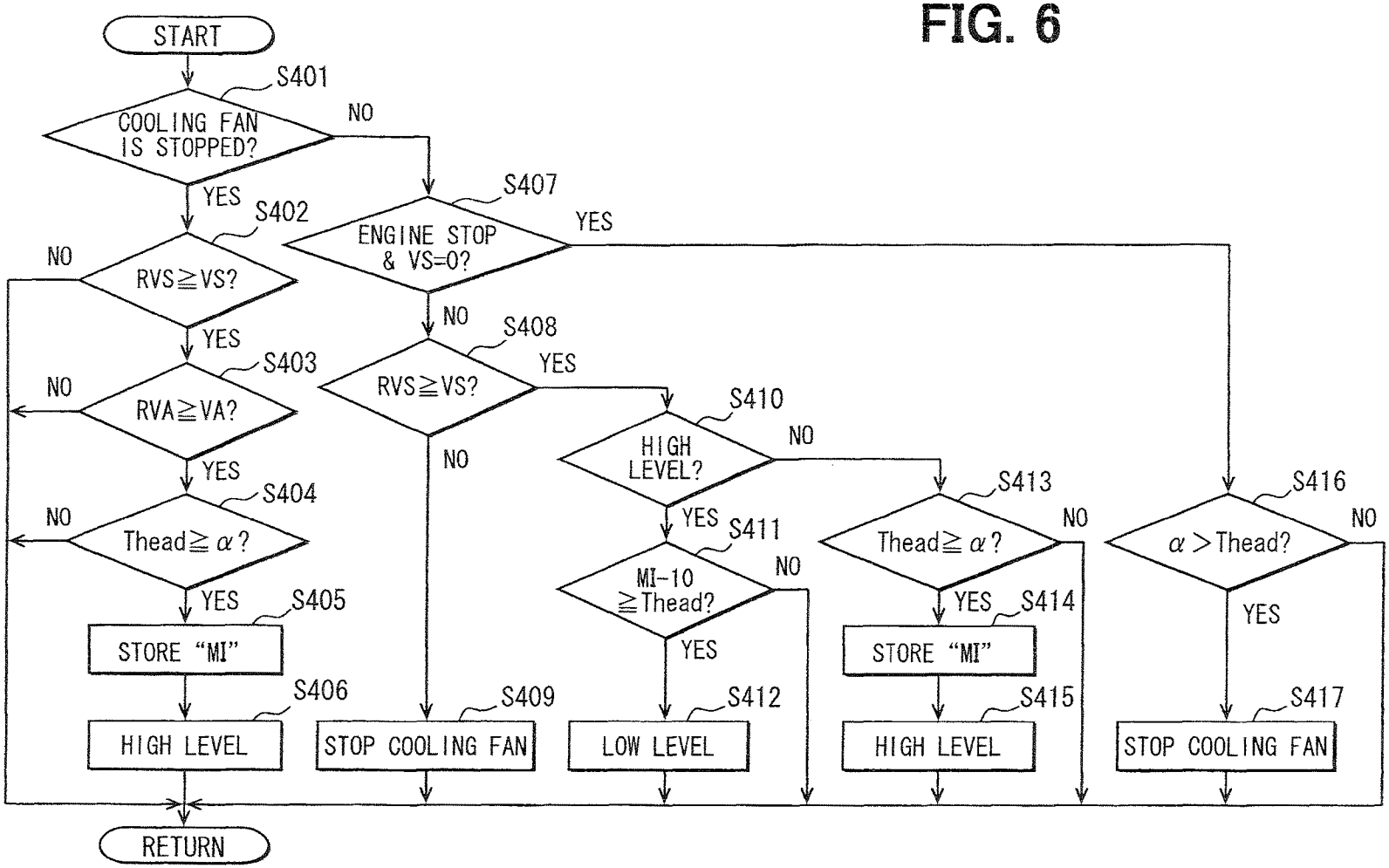
FIG. 6 is a flowchart showing a control processing of a cooling fan.

FIG. 6 is a flow chart showing the cooling fan control executed in step S113. This control processing corresponds to cooling fan control means of the present invention.

In step S401, the computer determines whether the cooling fan 56 is stopped. When the answer is YES, the procedure proceeds to step S402 in which the computer determines whether the vehicle speed "VS" is lower than or equal to the reference vehicle speed "RVS". When the answer is YES in step S402, the procedure proceeds to step S403 in which the computer determines whether the vehicle acceleration "VA" is less than or equal to a reference acceleration "RVA". The vehicle acceleration "VA" is computed based on the vehicle speed "VS" detected by the vehicle speed sensor 67. When the answer is YES in step S403, the procedure proceeds to step S404 in which the computer determines whether the head-coolant temperature "Thead" is greater than or equal to the coolant temperature threshold α.

When the answer is NO in any one of steps S402-S404, the procedure ends. When the answer is YES in every step S402-S404, the procedure proceeds to steps S405 and S406. In step S405, the current coolant temperature threshold α is stored as momentum information "MI". In step S406, the cooling fan 56 is started to be driven in high driving level. It should be noted that the momentum information "MI" stored in step S405 is independent from the momentum information "MI" stored in second water pump control shown in FIG. 5. When the answer is NO in step S401, the procedure proceeds to step S407 in which the computer determines whether the engine 10 is stopped and the vehicle speed "VS" is "0". When the answer is NO in step S407, the procedure proceeds to step S408 in which the computer determines whether the vehicle speed "VS" is less than or equal to a reference vehicle speed "RVS". When the answer is NO in step S408, the procedure proceeds to step S409 in which the cooling fan 56 is stopped.

That is, regardless of whether the head-coolant temperature "Thead" is greater than or equal to the threshold α, when the vehicle speed "VS" is greater than a specified value, the cooling fan 56 is stopped. Thereby, electric power consumption of the battery 24 can be reduced. Alternatively, a timing at which the cooling fan 56 is started to be driven can be retarded relative to a timing at which the head-coolant temperature "Thead" becomes greater than or equal to the threshold α, whereby hunting of the cooling fan 56 can be avoided.

When the answer is YES in step S408, the procedure proceeds to step S410 in which the computer determines whether the driving level of the cooling fan 56 is high driving level. When the answer is YES in step S410, the procedure proceeds to step S411 in which the computer determines whether the head-coolant temperature "Thead" is less than or equal to "MI−10". When the answer is YES in step S411, the procedure proceeds to step S412 in which the driving level of the cooling fan 56 is set to low driving level. The air flow rate per unit time in high driving level is greater than that in low driving level.

When the answer is NO in step S410, the procedure proceeds to step S413 in which the computer determines whether the head-coolant temperature "Thead" is greater than or equal to the coolant temperature threshold α. When the answer is YES in step S413, the procedure proceeds to step S414 in which the momentum information "MI" is stored. In step S415, the driving level of the cooling fan 56 is changed to the high driving level.

When the answer is NO in step S401 and the answer is YES in step S407, the procedure proceeds to step S416. In step S416, the computer determines whether the head-coolant temperature "Thead" is less than the coolant temperature threshold α. When the answer is YES in step S416, the procedure proceeds to step S417 in which the cooling fan 56 is stopped.

Figures 7A, 7B, 7C, 7D, 7E, 7F:
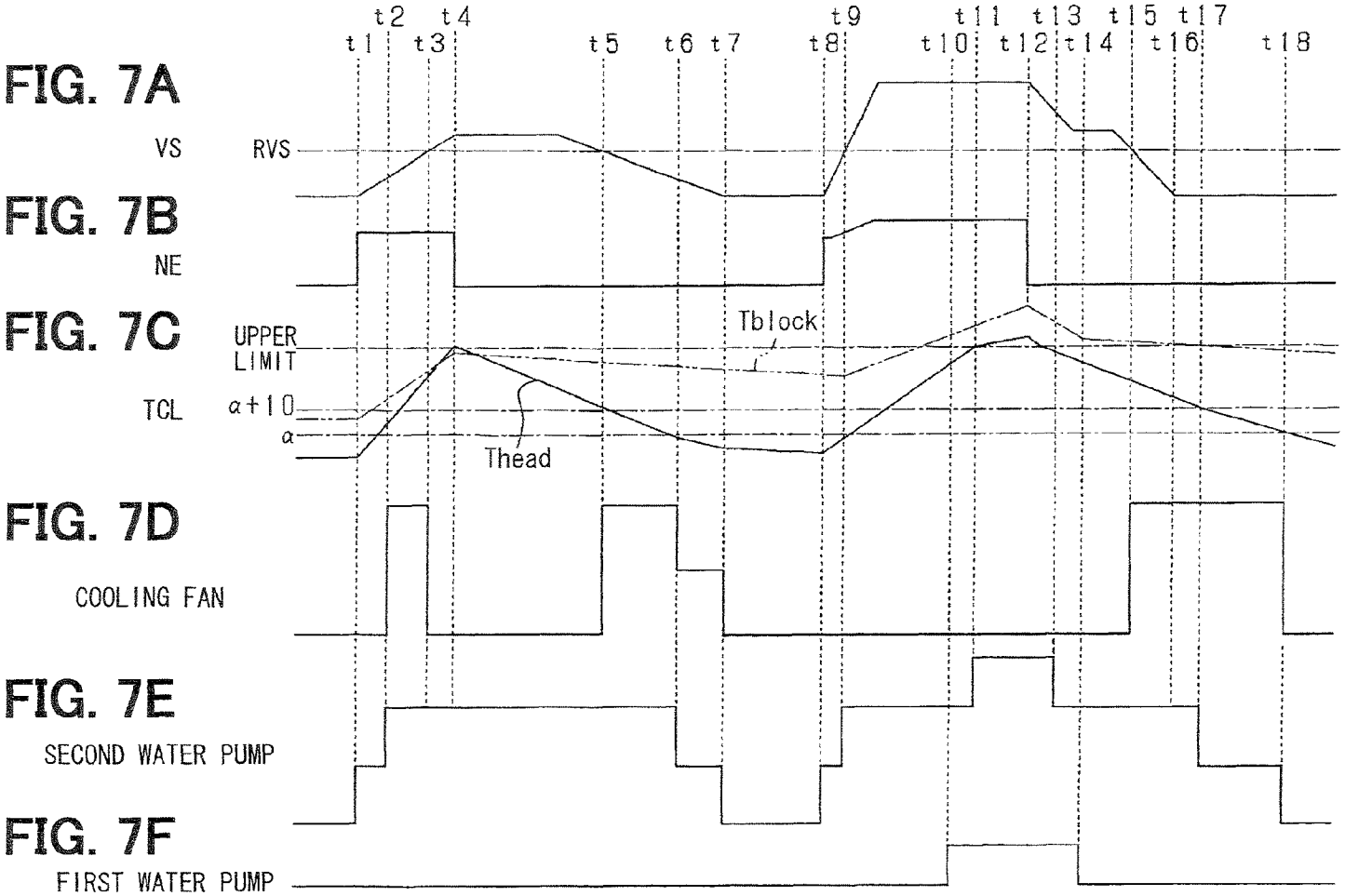
FIGS. 7A to 7F are time charts for explaining an operation of the cooling fan, the first water pump and the second water pump.

Referring to a time chart shown in FIGS. 7A-7F, operations of the cooling fan 56, the first water pump 53 and the second water pump 43 will be described, hereinafter. FIG. 7A shows the vehicle speed "VS", FIG. 7B shows the engine speed "NE", FIG. 7C shows the coolant temperature "TCL". In FIG. 7C, a solid line represents the head-coolant temperature "Thead" and a two-dashed line represents the block-coolant temperature "Tblock". FIG. 7D shows the driving level of the cooling fan 56, FIG. 7E shows the driving level of the second water pump 53, and FIG. 7F shows the driving level of the first water pump 43.

In a condition where an ignition switch is ON, a driver operates an accelerator pedal at timing t1. The motor generator 17 and the internal combustion engine 10 are started. Accordingly, the second water pump 53 is started in the low driving level.

Then, at timing t2, the head-coolant temperature "Thead" is higher than the coolant temperature threshold α and the cooling fan 56 is started in the high driving level. The driving level of the second water pump 53 is changed from the low driving level to the middle driving level. At timing t3, the vehicle speed "VS" exceeds the reference vehicle speed "RVS" and the cooling fan 56 is stopped.

At timing t4, the engine 10 is shut off. In this moment, the vehicle speed "VS" is not "0" and the head-coolant temperature "Thead" is greater than or equal to the threshold α, the second water pump 53 is driven in the middle driving level. Meanwhile, since the vehicle speed "VS" is greater than or equal to the reference vehicle speed "RVS", the cooling fan 56 is kept OFF.

Then, the vehicle speed "VS" is decelerated and the vehicle speed "VS" becomes lower than the reference vehicle speed "RVS" at timing t5. The cooling fan is restarted in high driving level. At timing t6, the head-coolant temperature "Thead" becomes lower than the coolant temperature threshold α. At this moment, since the vehicle speed "VS" in not "0", the cooling fan 56 and the second water pump 53 are driven in the low driving level. At timing t7, the vehicle speed "VS" becomes "0" and the cooling fan 56 and the second water pump 53 are stopped. In the above flow, since the block-coolant temperature "Tblock" is not greater than the start reference temperature "TSAR", the first water pump 43 is kept stopped, so that the block-coolant temperature "Tblock" is increasing.

At timing t8, the driver operates the accelerator pedal to start the engine 10, so that the second water pump 53 is started in the low driving level.

At timing t9, the head-coolant temperature "Thead" exceeds the threshold α and the driving level of the second water pump 53 is changed to the middle driving level. It should be noted that the vehicle acceleration "VA" is greater than the reference acceleration "RVA" at this moment. Thus, the cooling fan 56 is kept stopped.

Then, the operation of the engine 10 is continued and the waste heat quantity of the engine 10 increases. At timing t10, the block-coolant temperature "Tblock" is greater than the start reference temperature "TSAR" and the first water pump 43 is started in the low driving level. At timing t11, the head-coolant temperature "Thead" exceeds the upper limit temperature "TUL", so that the driving level of the second water pump 53 is changed to the high driving level.

The engine 10 is shut off at timing t12, so that the increase in head-coolant temperature "Thead" and block-coolant temperature "Tblock" is stopped. At timing t13, the head-coolant temperature "Thead" becomes lower than the upper limit temperature "TUL", so that the driving level of the second water pump 53 is changed to the middle divining level. At timing t14, the block-coolant temperature "Tblock" becomes lower than the stop reference temperature "TSOR", so that the first water pump 43 is stopped.

Then, the vehicle speed "VS" is further decelerated and the cooling fan 56 is started in the high driving level at timing t15. At timing t16, the vehicle speed "VS" becomes "0". It should be noted that since the head-coolant temperature "Thead" is significantly greater than the coolant temperature threshold α, the cooling fan 56 and the second water pump 53 are kept driven in the current driving level.

Then, at timing t17, since the head-coolant temperature "Thead" becomes lower than "threshold α+10", the driving level of the second water pump 53 is changed to the low driving level. At timing t18, since the head-coolant temperature "Thead" becomes lower than the threshold α, both the cooling fan 56 and the second water pump 53 are stopped.

According to this embodiment explained above, the following advantages are obtained.

After the engine 10 is shut off, if the head-coolant temperature "Thead" is greater than the threshold α, the engine coolant is circulated to cool the cylinder head 12. Thereby, even if the engine 10 is shut off in a condition where the head-coolant temperature "Thead" is high, the temperature of the cylinder head 12 will decrease to the desired value for improving the anti-knocking ability at a time of restarting the engine 10. Thus, even when the engine 10 is restarted after the idle reduction control, the anti-knocking ability is improved and the fuel consumption efficiency can be enhanced.

Even when the engine 10 is shut off, if the vehicle speed "VS" is not "0", it is likely that the engine 10 is restarted. That is, when the driver slightly steps on the accelerator pedal, the engine 10 is restarted. In such a situation, without respect to the head-coolant temperature "Thead", the second water pump 53 is continuously driven. Meanwhile, when the engine 10 is off and the vehicle speed "VS" is "0", the second water pump 53 is stopped according to the head-coolant temperature "Thead". Thereby, in a situation that the head-coolant temperature "Thead" will increase, the head-coolant temperature "Thead" is decreased prior to a reducing of the power consumption of the battery 24. In a situation that the head-coolant temperature "Thead" will decrease without circulating the engine coolant, the reducing of the power consumption of the battery has a priority to the decreasing of the head-coolant temperature "Thead". Therefore, while reducing the power consumption of the battery 24, the head-coolant temperature "Thead" can be kept low.

When the engine 10 is stopped and the vehicle speed "VS" is "0", the driving level of the second water pump 53 is the middle driving level or the low driving level. Even when the head-coolant temperature "Thead" is greater than or equal to the threshold α, as long as a difference between the head-coolant temperature "Thead" and the threshold α is within a specified range, the second water pump 53 is driven in the low driving level. Thereby, in a situation that the head-coolant temperature "Thead" will decrease without circulating the engine coolant, the power saving of the battery 24 can be achieved.

Even after the engine 10 is shut off, if the head-coolant temperature "Thead" is greater than the threshold α, the cooling fan 56 is driven to cool the engine coolant flowing through the cylinder head 12. Thus, even when the vehicle speed "VS" is low or zero after the engine is shut off, the engine coolant is efficiently cooled by the cooling fan 56, so that the cylinder head 12 can be cooled rapidly after the engine 10 is shut down.

Further, when the engine 10 is restarted with the second water pump 53 stopped, the second water pump 53 is also restarted. Thus, a rapid increase in temperature of the cylinder head 12 can be restricted easier than a case where the second water pump 53 is started when the head-coolant temperature "Thead" exceeds the coolant temperature threshold α. On the other hand, in the case that the head-coolant temperature "Thead" does not exceed the threshold α, even if the engine coolant is cooled, a cooling effect is not high. Even if the engine 10 is restarted, the cooling fan 56 is not started. The cooling fan 56 is started when the head-coolant temperature "Thead" exceeds the coolant temperature threshold α. Therefore, the electric power for driving the cooling fan 56 can be saved.

Second Embodiment

Figure 8A:
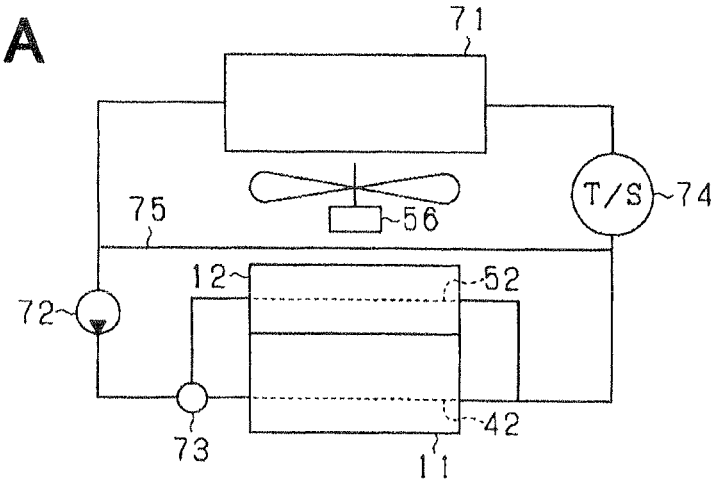
FIGS. 8A to 8C are schematic charts showing another cooling systems.

As shown in FIG. 8A, the cylinder-block-passage and the cylinder-head-passage can be combined as one passage.

Specifically, a flow rate control valve 73 is disposed at a branch portion of the water jackets 42, 52. According to control signals from the ECU 61, the flow rate control valve 73 controls the flow rate of engine coolant flowing through each water jacket 42, 52. A water temperature sensor is provided to each of outlets of the water jackets 42, 52 to detect the head-coolant temperature "Thead" and the block-coolant temperature "Tblock". The ECU 61 controls the water pump 72 and the flow rate control valve 73 in order to control the head-coolant temperature "Thead" and the block-coolant temperature "Tblock".

A thermostat 74 is provided in the coolant passage. A bypass passage 75 is provided which bypasses the radiator 71. When the engine coolant temperature is low, the engine coolant flows through the bypass passage 75. The thermostat 74 is a well known mechanical thermostat or an electrical thermostat. The bypass passage 75 can be provided to the engine cooling system 40 in the first embodiment.

Figure 8B:
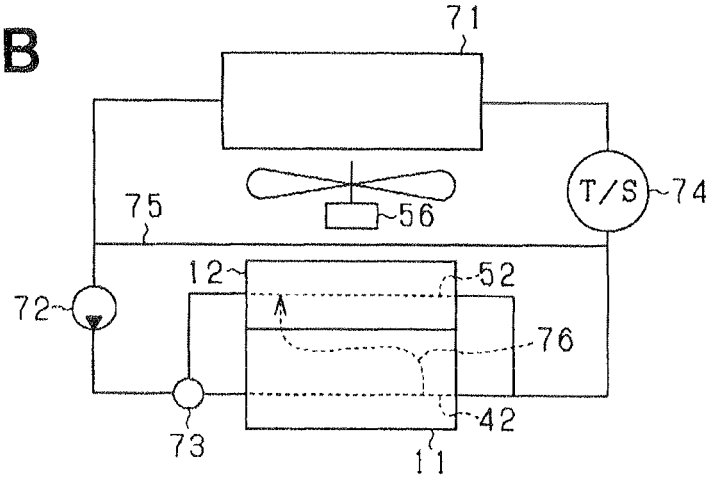
Figure 8C:
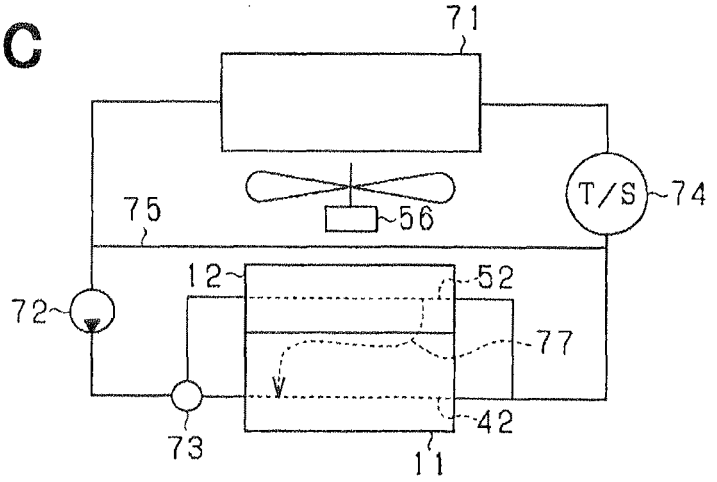

Alternatively, as shown in FIG. 8B, the engine coolant passed through the water jacket 42 can be introduced into the water jacket 52 through a bypass passage 76. Alternatively, as shown in FIG. 8C, the engine coolant passed through the water jacket 52 can be introduced into the water jacket 42 through a bypass passage 77.

Other Embodiment

The present invention is not limited to the above-mentioned embodiments, for example, may be performed as follows.

The first water pump 43 is a mechanical water pump and the second water pump 53 is an electric water pump which can be driven even after the engine 10 is shut off. Since the first water pump 43 is driven by the engine torque, the electric power of the battery 24 can be saved.

The coolant temperature threshold α can be varied between when the engine 10 is ON and when the engine 10 is OFF. For example, when the engine is OFF, the threshold α can be set larger by a specified value than that of when the engine is ON. In this case, the threshold α is set for improving the anti-knocking ability. The electric power of the battery 24 can be saved.

When the vehicle speed "VS" is greater than "0" and is less than a specified speed (for example, 10 km/h), the second water pump 53 can be stopped in a case that the head-coolant temperature "Thead" is not greater than the threshold α.

The engine coolant flowing through the cylinder head 12 can be cooled by the evaporator of the air conditioning system 30.

The driving levels of the first water pump 43, the second water pump 53 and the cooling fan 56 can be changed continuously instead of stepwise.

Even when the engine is OFF, the second water pump 53 can be started according to a variation in head-coolant temperature "Thead".

The present invention can be applied to a hybrid vehicle and a vehicle having a function of idle reduction control. Also, the present invention can be applied to a vehicle equipped with a conventional engine. Further, the present invention can be applied to a vehicle equipped with a supercharger. In such a vehicle, high compression ratio can be obtained. In the above embodiment, the water jacket 42 and the water jacket 52 are fluidly connected in parallel. Alternatively, these water jackets 42, 52 are fluidly connected in series.

Third Embodiment

Figure 9:
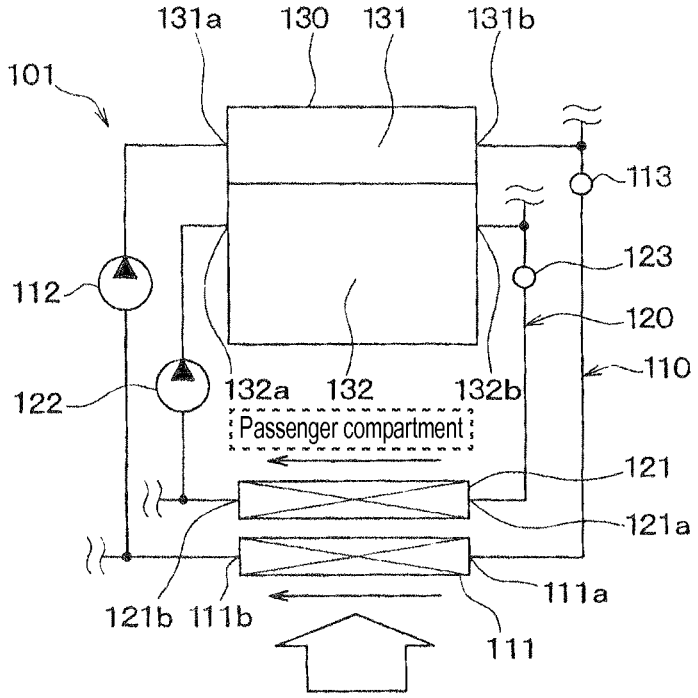
FIG. 9 is a chart schematically showing an entire structure of an air conditioner according to a third embodiment.

FIG. 9 schematically shows an entire structure of an air conditioner according to third embodiment. An air-conditioner is provided to a hybrid vehicle.

The air-conditioner 101 is provided with a first coolant circuit 110 and a second coolant circuit 120. The engine coolant passed through a cylinder head 131 flows in the first coolant circuit 110. The first coolant circuit 110 includes a first heater core 111, a first water pump 112, and a first temperature sensor 113. The engine coolant passed through a cylinder block 132 flows in the second coolant circuit 120. The second coolant circuit 120 includes a second heater core 121, a second water pump 122, and a second temperature sensor 123.

A cylinder block 132 and a cylinder head 131 of the engine 130 have well-known configuration.

The cylinder head 131 has a first coolant inlet 131*a* and a first coolant outlet 131*b*. The engine coolant flows through a coolant passage formed in the cylinder head 131. The coolant flows into the coolant passage through the first coolant inlet 131*a*, and flows out from the coolant passage through the first coolant outlet 131*b*.

Similarly, the cylinder block 132 has a second coolant inlet 132*a* and a second coolant outlet 132*b*. The engine coolant flows into a coolant passage formed in the cylinder block 132 through the second coolant inlet 132*a*, and flow out through the second coolant outlet 132*b*.

The first heater core 111 and the second heater core 121 have well known configuration comprised of tubes and fins.

In this embodiment, the first heater core 111 and the second heater core 121 are fluidly independent from each other.

A coolant inlet 111*a* of the first heater core 111 is connected to the first coolant outlet 131*b* through a pipe. A coolant inlet 121*a* of the second heater core 121 is connected to the second coolant outlet 132*b* through a pipe.

The first heater core 111 and the second heater core 121 are accommodated in a duct (not shown) of the air-conditioner. The first heater core 111 and the second heater core 121 are arranged in series with respect to an air flow. The second heater core 121 is arranged downstream of the first heater core 111.

A first temperature sensor 113 is disposed between the first coolant outlet 131*b* and the coolant inlet 111*a* of the first heater core 111, so that the first temperature sensor 113 detects temperature of coolant discharged from the first coolant outlet 131*b*. A second temperature sensor 123 is disposed between the second coolant outlet 132*b* and the coolant inlet 121*a* of the second heater core 121, so that the second temperature sensor 123 detects temperature of coolant discharged from the second coolant outlet 132*b*.

A first water pump 112 and a second water pump 122 generate coolant flow and adjust coolant flow rate. The first water pump 112 is arranged between the coolant outlet 111*b* of the first heater core 111 and the first coolant inlet 131*a* of the cylinder head 131. The second water pump 122 is arranged between the coolant outlet 121*b* of the second heater core 121 and the second coolant inlet 132*a* of the cylinder block 132.

The first water pump 112 and the second water pump 122 are electric pumps. In the present embodiment, the first water pump 112 and the second water pump 122 are controlled in such a manner that the coolant flow rate in the cylinder head 131 is greater than that in the cylinder block 132.

In the first coolant circuit 110, the coolant discharged from the first coolant outlet 131*b* flows into the first heater core 111, then flows into the engine 130 through the first coolant inlet 131*a*.

In the second coolant circuit 120, the coolant discharged from the second coolant outlet 132*b* flows into the second heater core 121, then flows into the engine 130 through the second coolant inlet 132*a*.

It should be noted that both the first coolant circuit 110 and the second coolant circuit are fluidly connected to a radiator (not shown).

An operation of the air-conditioner 101 will be described hereinafter.

Figure 10:
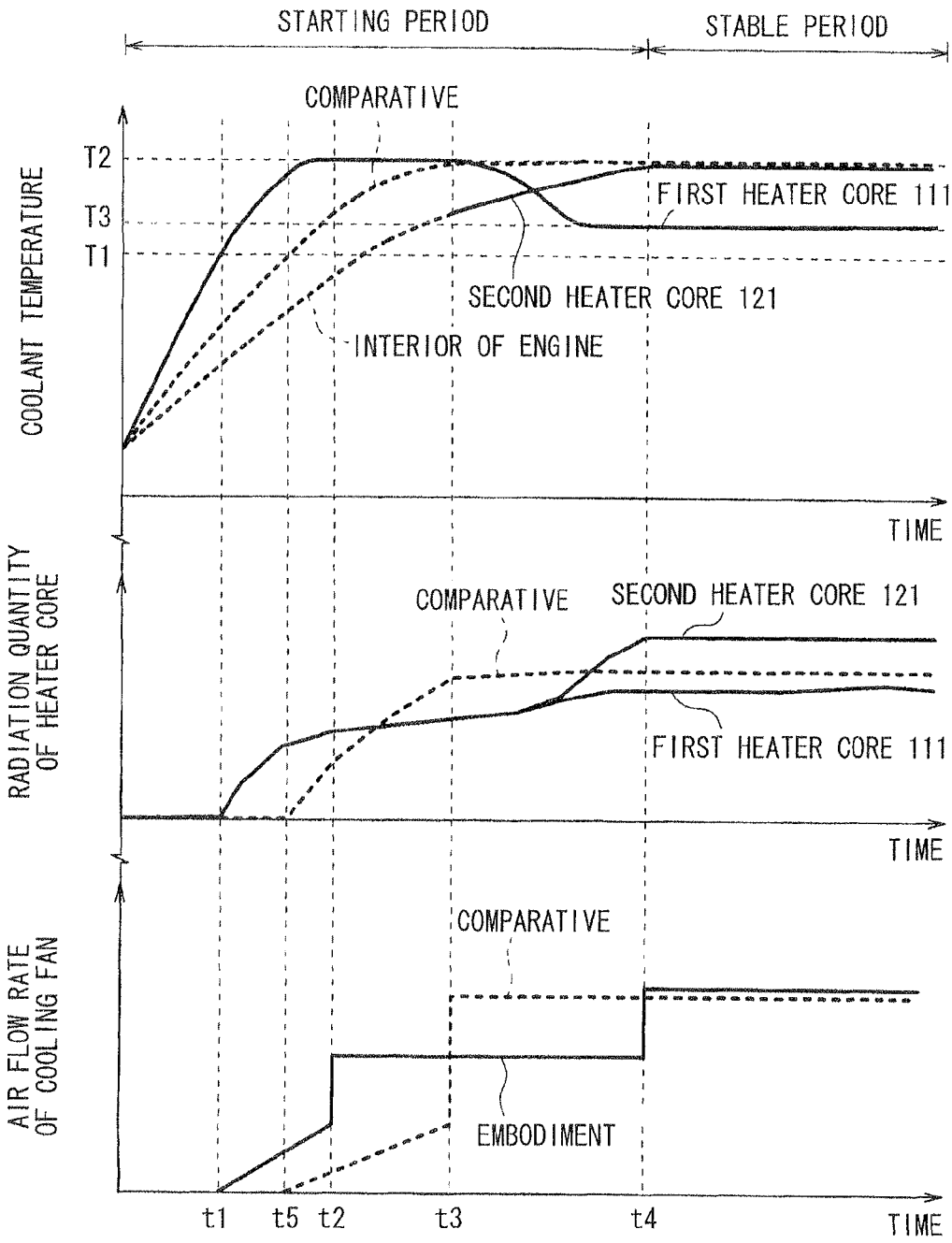
FIG. 10 is a time chart showing a coolant temperature, a radiation heat quantity of heater cores and air flow rate of cooling fan.

FIG. 10 is a time chart showing a coolant temperature, a radiation heat quantity of heater cores 111, 121 and air flow rate of cooling fan. FIG. 10 shows a case where the coolant temperature rises to a minimum temperature necessary for heating and then the coolant temperature is maintained at this temperature.

During a starting period, a heating of the passenger compartment has priority.

Specifically, from a timing of an engine start until a timing t3, the second water pump 122 is stopped and the first water pump 112 is driven to circulate a specified quantity of the coolant in the first coolant circuit 110. Thereby, the coolant is circulated only in the first coolant circuit 110. The temperature of coolant flowing into the first core 111 is increased. At this moment, the circulating coolant flow rate is defined in such a manner that the coolant temperature reaches the first specified temperature T1 and the second specified temperature T2 as soon as possible.

When the coolant temperature detected by the first temperature sensor 113 becomes a first specified temperature T1 at a timing t1, the cooling fan is started. Then, when the coolant temperature becomes a second specified temperature T2 at timing t2, the air flow rate of the cooling fan is increased to a specified value. It should be noted that the second specified temperature T2 is a minimum temperature necessary for obtaining a target outlet air temperature. The second specified temperature T2 is a reference temperature on which the computer determines whether the engine should be driven to heat the passenger compartment. Further, the first specified temperature T1 is temperature at which the air can be introduced into the passenger compartment.

At a timing t3, the second water pump 122 is started and the first water pump 111 is controlled in such a manner that the coolant flow rate in the cylinder head 131 is increased.

At a timing t4, a warm-up of the engine 130 is completed. After the timing t4, the engine 130 is operated in a stable condition. The computer controls the first and the second water pump 112, 122 in such a manner that the coolant flow rate in the cylinder head 131 is greater than that in the cylinder block 132.

Specifically, the first water pump 112 is controlled so that the coolant temperature flowing into the first heater core 111 reaches a third specified temperature T3. The third specified temperature T3 is a target temperature of the coolant passed through the cylinder head 131, which is established for positively cooling the cylinder head 131. Further, the computer controls the second water pump 122 is such a manner that the coolant temperature flowing into the second heater core 121 becomes the second specified temperature T2.

According to the above, the cylinder head 131 is kept at low temperature so that the anti-knocking ability is improved. Also, the cylinder block 132 is kept at high temperature so that viscosity of engine oil is hardly deteriorated. Thus, an increase in friction of the engine can be restricted.

The computer controls the cooling fan in such a manner that air flow rate of the cooling fan corresponds to a target air temperature TAO.

FIG. 10 also shows a comparative example in which the coolant passed through the cylinder head 131 and the coolant passed through the cylinder block 132 are merged in the engine 130. The merged coolant flows out from the engine 130 through a single coolant outlet and flows into a single heater core. Further, in the comparative example, a ratio between the coolant flow rate in the cylinder head and the coolant flow rate in the cylinder block is fixed value. When the engine is operated in a stable condition, the coolant flow rate discharged from the engine is the same as the third embodiment.

In the comparative example, at a timing t5, the coolant temperature reaches the first specified temperature T1 and the cooling fan is started. At a timing t3, the coolant temperature reaches the second specified temperature T2 and the cooling fan is driven to obtain the air flow rate corresponding to the target air temperature TAO.

By comparing the present embodiment with the comparative example as shown in FIG. 10, it is apparent that an increase in the coolant temperature flowing into the first heater core 111 can be accelerated, so that heating of a passenger compartment can be early conducted in the present embodiment.

Furthermore, according to the present embodiment, when the engine is driven in a stable condition, a radiation heat quantity of the second heater core 121 is greater than that of the comparative example. Consequently, as shown in FIG. 11, the air temperature passed through the second heater core 121 can be made greater than that of the comparative example.

Figure 11:
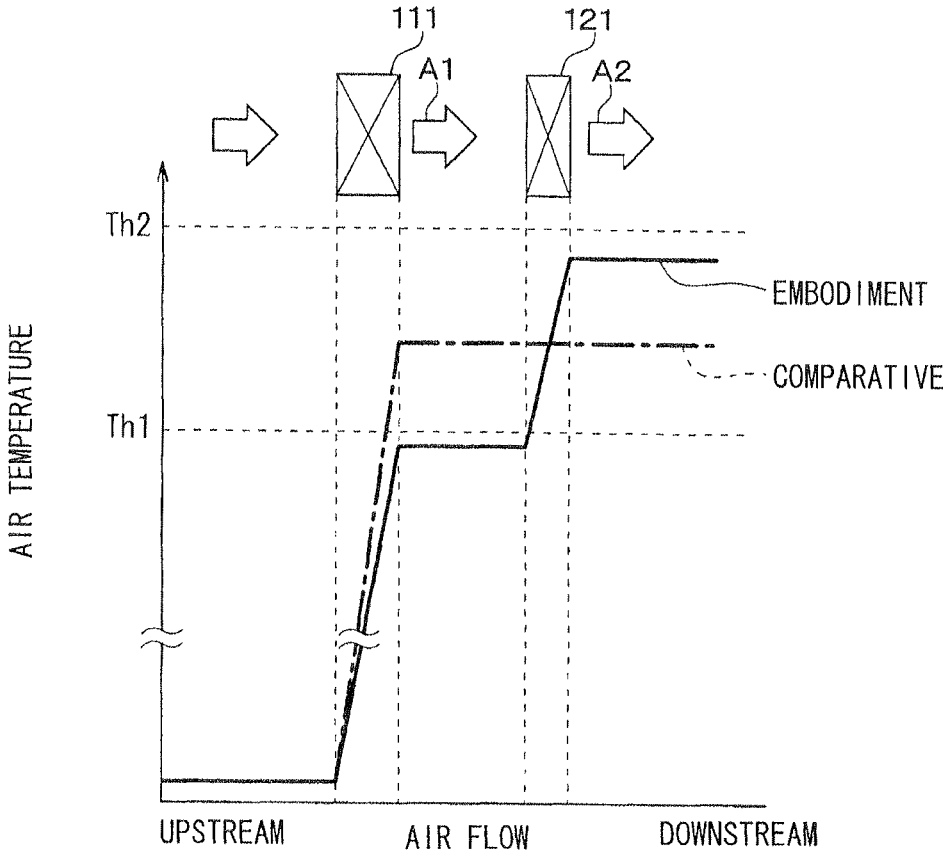
FIG. 11 is a graph showing a variation in air temperature passed through the first heater core and the second heater core.

FIG. 11 is a graph showing a variation in air temperature passed through the first heater core 111 and the second heater core 121.

In the first heater core 111, the coolant passed through the cylinder head 131 is heat-exchanged with the air passing through the first heater core 111. Although the coolant temperature passed through the cylinder head 131 is lower that a minimum temperature required for heating the passenger compartment, the passing air can receive a lot of heat from the coolant of which flow rate is larger than that of the coolant passed through the cylinder block 132. As a result, the temperature of air A1 passed through the first heater core 111 comes close to the coolant temperature Th1 before flowing into the first heater core 111.

In the second heater core 121, the coolant passed through the cylinder block 132 is heat-exchanged with the air A1 passed through the first heater core 111. Since the coolant temperature passed through the cylinder block 132 is higher than the coolant temperature passed through the cylinder head 131, the temperature of air A2 passed through the second heater core 121 can be made higher that that of the air A1.

At this time, the computer adjusts the coolant flow rate passing through the second heater core 121 by controlling the second water pump 122.

Advantages of the present embodiment will be described hereinafter.

Since the second heater core 121 heats the passing air by heat-exchanging with the high temperature coolant discharged from the second coolant outlet 132*b*, the air temperature passed through the second heater core 121 can be increased more than the case where the air is heated by the low temperature coolant discharged from the first coolant outlet 131*b* or the case where the high-temperature coolant and the low-temperature coolant is merged.

Furthermore, according to the present embodiment, the air is heated by using of low-temperature coolant passing through the first heater core 111 and high-temperature coolant passing through the second heater core 121.

Energy transfer efficiency from the coolant to the air can be enhanced.

Even if the air flow rate of the cooling fan is large, the air can be heated well enough to heat the passenger compartment.

It should be noted that the temperature of air A1 may be greater than the second specified temperature T2.

Fourth Embodiment

Figure 12:
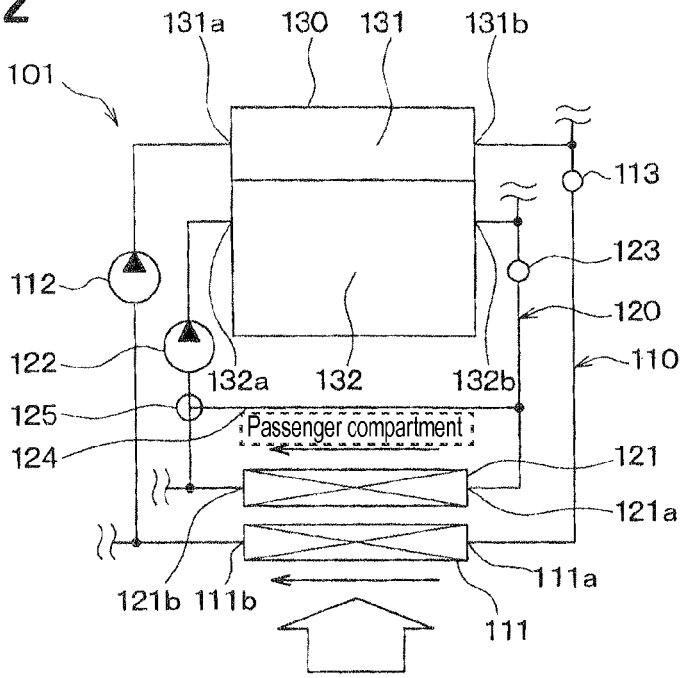
FIG. 12 is a chart schematically showing an entire structure of an air conditioner according to a fourth embodiment.

FIG. 12 schematically shows an entire structure of an air conditioner according to a fourth embodiment. In the present embodiment, the second coolant circuit 120 has a bypass passage 124 and a flow path selector valve 125.

The bypass passage 124 bypasses the second heater core 121. The flow path selector valve 125 switches a flow path between the bypass passage 124 and the second hater core 121.

During a starting period of the engine, the engine coolant flows through the bypass passage 124.

The flow path selector valve 125 can be replaced by a flow regulating valve.

Fifth Embodiment

Figure 13:
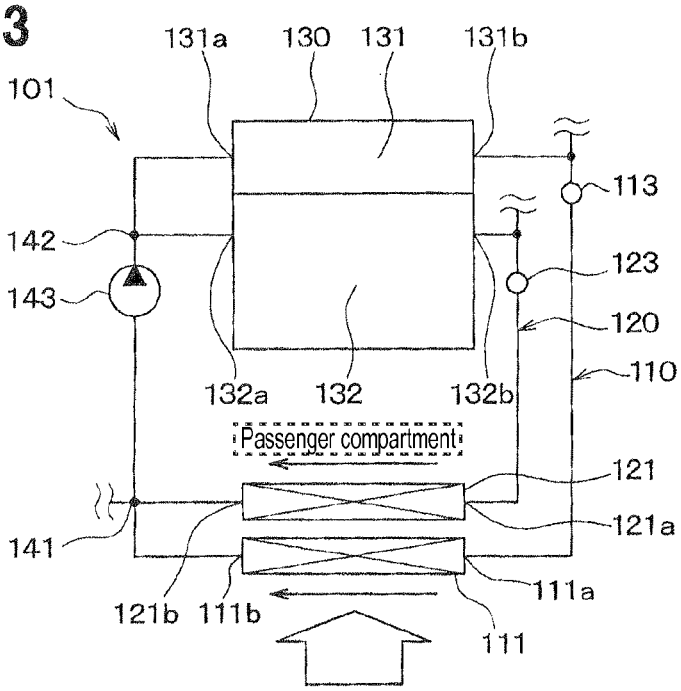
FIG. 13 is a chart schematically showing an entire structure of an air conditioner according to a fifth embodiment.

FIG. 13 schematically shows an entire structure of an air conditioner according to a fifth embodiment.

The coolant passed through the first heater core 111 and the coolant passed through the second heater core 121 merges at a confluent portion 141. Then, the coolant is divided into two flows at a diversion portion 142 toward the first coolant inlet 131*a* and the second coolant inlet 132*a*. A single water pump 143 circulates the coolant.

In the present embodiment, a hydraulic resistance in the first coolant circuit 110 is set lower than that in the second coolant circuit 120, so that the coolant flow rate in the cylinder head 131 is greater than that in the cylinder block 132. For example, the passage sectional area of the coolant passage in the cylinder head 131 is larger than that in the cylinder block 132.

Sixth Embodiment

Figure 14:
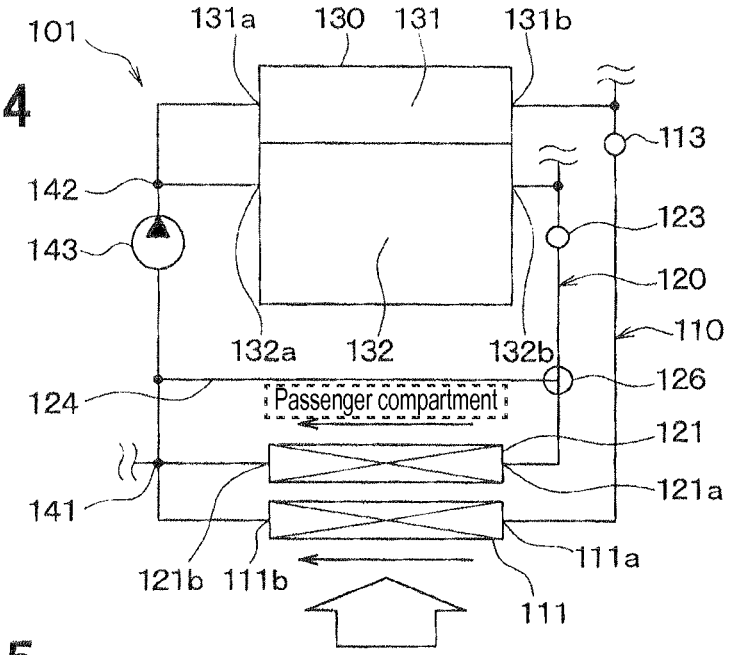
FIG. 14 is a chart schematically showing an entire structure of an air conditioner according to a sixth embodiment.

FIG. 14 schematically shows an entire structure of an air conditioner according to a sixth embodiment. The present embodiment is based on the fifth embodiment shown in FIG. 13. A bypass passage 124 and a flow regulating valve 126 are added to the fifth embodiment.

The computer controls the flow regulating valve 126 in such a manner that the coolant flow rate in the cylinder head 131 is greater than that in the cylinder block 132.

Seventh Embodiment

Figure 15:
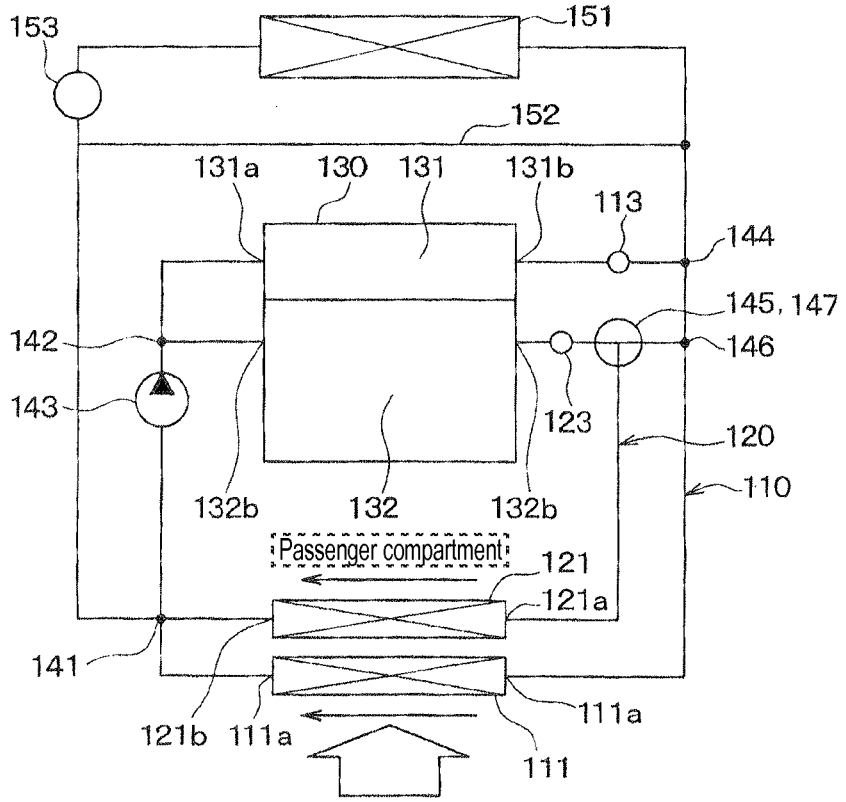
FIG. 15 is a chart schematically showing an entire structure of an air conditioner according to a seventh embodiment.

FIG. 15 schematically shows an entire structure of an air conditioner according to a seventh embodiment. In the present embodiment, the fifth embodiment shown in FIG. 13 is modified as follows.

That is, a diversion portion 142 is formed between the first coolant outlet 131*b* and the first heater core 111. The coolant discharged from the first coolant outlet 131*b* is diverged at the diversion portion 142. The diverged coolant flows into a radiator 151, and then merged at a confluent portion 141.

Further, a bypass passage 152 and a thermostat 153 are provided.

A diversion portion 145 is formed between the second coolant inlet 132*b* and the second heater core 121, and a confulent portion 146 is formed between the first coolant outlet 131*b* and the first heater core 111. A flow regulating valve 147 is provided at the diversion portion 145. The flow regulating valve 147 adjusts the coolant flow rate which flows toward the second heater core 121 and the confluent portion 146.

When the coolant flow rate flowing toward the confluent portion 146 is "0", all of the high-temperature coolant discharged from the second coolant outlet 132*b* flows into the second heater core 121.

Alternatively, a part of the high-temperature coolant discharged from the second coolant outlet 132*b* is merged with the low-temperature coolant discharged from the first coolant outlet 131*b* and then flows into the first heater core 111. The other high-temperature coolant discharged from the second coolant outlet 132*b* flows into the second heater core 121.

Eighth Embodiment

Figure 16:
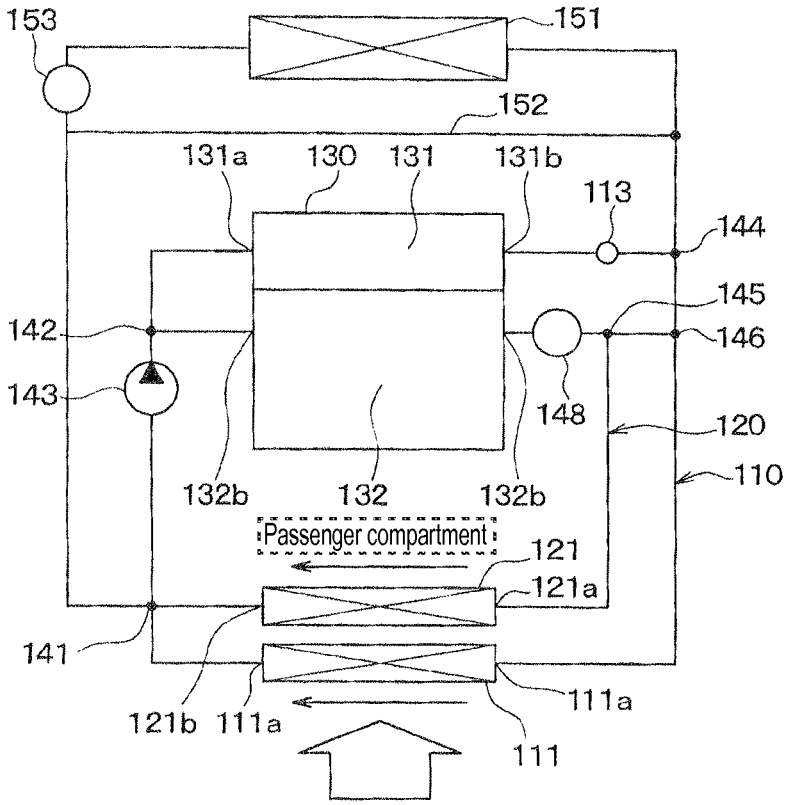
FIG. 16 is a chart schematically showing an entire structure of an air conditioner according to an eighth embodiment.

FIG. 16 schematically shows an entire structure of an air conditioner according to an eighth embodiment. In the present embodiment, the seventh embodiment shown in FIG. 15 is modified so that the flow regulating valve 147 is replaced by a thermostat 148.

When the thermostat 148 is opened, a part of the high-temperature coolant discharged from the second coolant outlet 132*b* is merged with the low-temperature coolant discharged from the first coolant outlet 131*b* and then flows into the first heater core 111. The other high-temperature coolant discharged from the second coolant outlet 132*b* flows into the second heater core 121.

Ninth Embodiment

Figure 17:
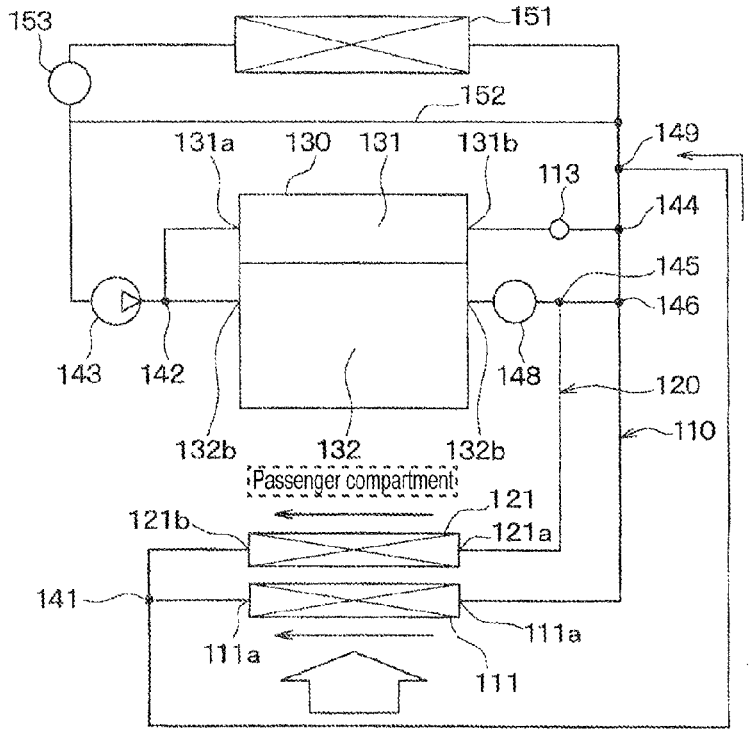
FIG. 17 is a chart schematically showing an entire structure of an air conditioner according to a ninth embodiment.

FIG. 17 schematically shows an entire structure of an air conditioner according to a ninth embodiment. The ninth embodiment is a modification of the eighth embodiment. A confluent portion 149 is formed upstream of a radiator 151. This confluent portion 149 is fluidly connected to a confluent portion 141 downstream of the first and the second heater core 111, 121. The coolant discharged from the radiator 151 flows into a water pump 143.

Since the coolant passed through the first and the second heater core 111, 121 flows into the radiator to be cooled, the coolant temperature flowing into the cylinder head 131 can be made low.

Tenth Embodiment

Figure 18:
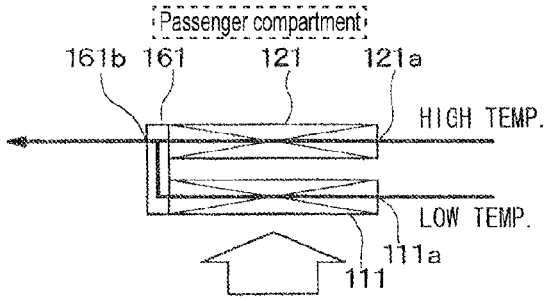
FIG. 18 is a chart showing a first heater core and a second heater core according to a tenth embodiment.

FIG. 18 shows a first heater core 111 and a second heater core 121. The first heater core 111 and the second heater core 121 are integrated to one unit.

The first heater core 111 has an inlet tank having an inlet 111*a* and a plurality of tubes. Also, the second heater core 121 has an inlet tank having an inlet 121*a* and a plurality of tubes. The first heater core 111 and the second heater core 121 have a common outlet tank 161. The outlet tank 161 has an outlet 161*b*.

The low-temperature coolant passed through the first heater core 111 and the high-temperature coolant passed through the second heater core 121 are merged in the outlet tank 161.

Eleventh Embodiment

Figure 19:
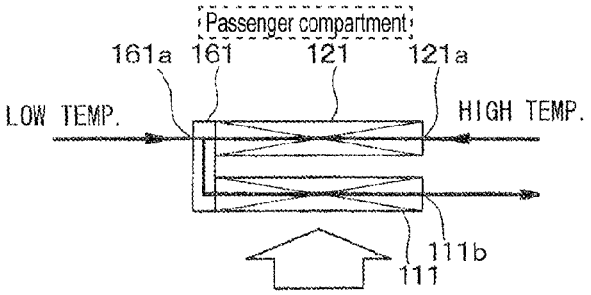
FIG. 19 is a chart showing a first heater core and a second heater core according to an eleventh embodiment.

FIG. 19 shows a first heater core 111 and a second heater core 121. The first heater core 111 and the second heater core 121 are integrated to one unit.

The first heater core 111 has an outlet tank having an outlet 111*b* and a plurality of tubes. Also, the second heater core 121 has an inlet tank having an inlet 121*a* and a plurality of tubes. The first heater core 111 and the second heater core 121 have a common header tank 161. This header tank 161 has an inlet 161*a* which communicates with the first coolant outlet 131*b* of the cylinder head 131.

Thereby, the high-temperature coolant discharged from the second coolant outlet 132*b* flows through the second heater core 121 and flows into the common header tank 161. In the common header tank 161, this coolant merges with the low-temperature coolant discharged from the first coolant outlet 131*b* of the cylinder head 131. The merged coolant flows through the first heater core 111 and flows out from the outlet 111*b* of the heater core 111.

Other Embodiment

In the above embodiments, the coolant discharged from the first coolant outlet 131*b* is the coolant which has cooled the cylinder head 131. Alternatively, the coolant discharged from the coolant outlet 131*b* may include a part of the coolant which has cooled the cylinder block 132.

Also, in the above embodiments, the coolant discharged from the second coolant outlet 132*b* is the coolant which has cooled the cylinder block 132. Alternatively, the coolant discharged from the second coolant outlet 132*b* may include a part of the coolant which has cooled the cylinder head 131. The coolant temperature discharged from the second coolant outlet 132*b* is higher than that discharged from the first coolant outlet 131*b*.

It should be noted that the coolant temperature discharged from the second coolant outlet 132*b* is highest.

In the above embodiments, the coolant flowing into the second heater core 121 is the coolant discharged from the second coolant outlet 132*b*. This coolant may include a part of the coolant discharged from the first coolant outlet 131*b*.

It should be noted that the coolant temperature flowing into the second heater core 121 is higher than an average temperature of the coolant discharged from the second coolant outlet 132*b* and the coolant discharged from the first coolant outlet 131*b*.

The coolant flow rate flowing into the first heater core 111 can be set equal to the coolant flow rate flowing into the second heater core 121.

In the fifth to ninth embodiments, the engine 130 has the first coolant inlet 131*a* and the second coolant inlet 132*a*. Alternatively, the engine 130 may have only one coolant inlet.

The first heater core 111 and the second heater core 121 may be arranged in parallel.

The coolant temperature flowing into the first heater core 111 can be maintained at the third specified temperature T3.

In the above embodiments, the waste heat of an engine for a hybrid vehicle is utilized as a heat source. Alternatively, waste heat of supercharging engine, a range extender and the like can be utilized as a heat source.

The coolant is selected from various kinds of fluid for cooling the engine. Each of the above embodiments can be properly combined.

What is claimed is:

1. An air-conditioning system for an automobile, comprising a heat-exchanger for heating an air with a first coolant and a second coolant of an internal combustion engine, and an electronic control unit comprising a processor and memory, wherein the internal combustion engine includes a first coolant outlet through which the first coolant passed through a cylinder head flows out, and a second coolant outlet through which the second coolant passed through a cylinder block flows out, the heat-exchanger is comprised of a first heater core and a second heater core, the first heater core receives the first coolant from at least the first coolant outlet, the second heater core receives the second coolant from the second coolant outlet of which temperature is higher than that of the first coolant flowing into the first heater core, the second heater core is arranged downstream of the first heater core with respect to an airflow which flows through the first heater core and the second heater core toward and into a passenger compartment, the first coolant entering the first heater core from the first coolant outlet is fluidly independent from the second coolant entering the second heater core from the second coolant outlet, and the electronic control unit is configured to control a first flow rate of the first coolant entering the first heater core and to control a second flow rate of the second coolant entering the second heater core, such that the first flow rate received by the first heater core is greater than the second flow rate of the second coolant received by the second heater core.

2. The air-conditioning system according to claim 1, wherein the electronic control unit is configured to control a temperature of the passenger compartment by adjusting the airflow which flows through the first and the second heater cores toward and into the passenger compartment.

3. The air-conditioning system of claim 1, wherein the electronic control unit comprises a first electronic control unit that is configured to control an electric motor and a second electronic control unit that is configured to control the first flow rate of the first coolant entering the first heater core and to control the second flow rate of the second coolant entering the second heater core, the first electronic control unit and the second electronic control unit each having a processor and memory.

4. The air-conditioning system of claim 1, wherein the electronic control unit is configured to control a first pump that sets the first flow rate of the first coolant entering the first heater core and is configured to control a second pump that sets the second flow rate of the second coolant entering the second heater core.

5. The air-conditioning system of claim 1, wherein a first coolant circuit connects the first coolant outlet to the first heater core, the first coolant passing through the first coolant circuit, and the first coolant circuit having a first hydraulic resistance, a second coolant circuit connects the second coolant outlet to the second heater core, the second coolant passing through the second coolant circuit, and the second coolant circuit having a second hydraulic resistance, the first hydraulic resistance being lower than the second hydraulic resistance, such that the first flow rate received by the first heater core is greater than the second flow rate of the second coolant received by the second heater core.

6. The air-conditioning system of claim 1, wherein the electronic control unit is configured to control a flow regulating valve such that the first flow rate received by the first heater core is greater than the second flow rate of the second coolant received by the second heater core.

7. The air-conditioning system of claim 1, wherein the automobile comprises the internal combustion engine and the electric motor, the internal combustion engine and the electric motor each being configured to transmit torque to wheels of the automobile, and wherein the electronic control unit is configured to control an electric motor to transmit torque to wheels of the automobile at a time when the internal combustion engine is stopped.

* * * * *